US010557664B2

(12) United States Patent
Qiu et al.

(10) Patent No.: US 10,557,664 B2
(45) Date of Patent: Feb. 11, 2020

(54) DOUBLE COOLED DRAFT BEER MACHINE

(71) Applicants: Diqing Qiu, Taizhou (CN); Dilin Qiu, Taizhou (CN)

(72) Inventors: Diqing Qiu, Taizhou (CN); Dilin Qiu, Taizhou (CN)

(73) Assignee: Diqing Qiu, Taizhou (CN)

( * ) Notice: Subject to any disclaimer, the term of this patent is extended or adjusted under 35 U.S.C. 154(b) by 390 days.

(21) Appl. No.: 15/418,678

(22) Filed: Jan. 28, 2017

(65) Prior Publication Data

US 2018/0100692 A1 Apr. 12, 2018

(51) Int. Cl.

| | |
|---|---|
| ***F25D 31/00*** | (2006.01) |
| ***B67D 1/06*** | (2006.01) |
| ***B67D 1/08*** | (2006.01) |
| ***B67D 1/00*** | (2006.01) |
| ***F25D 11/00*** | (2006.01) |
| ***F25D 29/00*** | (2006.01) |

(52) U.S. Cl.

CPC ..... *F25D 31/002* (2013.01); *B67D 1/0004* (2013.01); *B67D 1/06* (2013.01); *B67D 1/0858* (2013.01); *B67D 1/0865* (2013.01); *B67D 1/0884* (2013.01); *B67D 1/0891* (2013.01); *F25D 11/00* (2013.01); *F25D 29/00* (2013.01); *F25D 31/006* (2013.01); *B67D 2001/0089* (2013.01); *B67D 2210/00133* (2013.01); *F25D 2400/28* (2013.01); *F25D 2700/12* (2013.01); *F25D 2700/16* (2013.01)

(58) Field of Classification Search

CPC ..... F25D 31/002; F25D 31/006; F25D 11/00; F25D 29/00; F25D 2400/28; F25D 2700/12; F25D 2700/16; B67D 1/0004; B67D 1/06; B67D 1/0858; B67D 1/0865; B67D 1/0867; B67D 1/0868; B67D 1/0884; B67D 1/0891; B67D 1/0857; B67D 2001/0089; B67D 2210/00049

USPC ..... 62/396

See application file for complete search history.

(56) References Cited

U.S. PATENT DOCUMENTS 2,682,160 A * 6/1954 Kromer ..... F25D 31/002 62/177
3,995,441 A * 12/1976 McMillin ..... B67D 1/005 62/177

FOREIGN PATENT DOCUMENTS

CN 2306223 Y 2/1999
WO WO2006103566 A2 10/2006

* cited by examiner

*Primary Examiner* — Joseph F Trpisovsky
(74) *Attorney, Agent, or Firm* — Minder Law Group; Willy H. Wong

(57) ABSTRACT

A double cooled draft beer machine comprises a cabinet, and there is a refrigeration circuit inside the cabinet, including a compressor, a condenser, and an evaporator. Inside the cabinet, there is a cold storage chamber used to hold the cask, and the evaporator can refrigerate the cold storage chamber. A beer pipe and a refrigeration tube which can refrigerate the beer pipe are also arranged inside the cabinet. The refrigeration tube is connected to the refrigeration circuit and in parallel with the evaporator. In the refrigeration circuit, at least one solenoid valve is set up. The present double cooled draft beer machine also comprises a relay and the first thermostat. The first thermostat is in series with the relay, and the contacts of the relay are connected to the solenoid of the solenoid valve, as well as the compressor.

4 Claims, 19 Drawing Sheets

DOUBLE COOLED DRAFT BEER MACHINE

RELATED APPLICATIONS

This application claims benefit of Chinese Patent Application No. CN 201610887014.9, filed Oct. 11, 2016.

The applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to the technical field of draft beer machines, and particularly to a double cooled draft beer machine.

Related Art

In hot summer, all people like drinking chilled beverages, such as beer, cola, milk, etc. At present, there are draft beer machines on the market, which can refrigerate beer for people to drink. A draft beer machine is the main part of beer and beverage equipment. A full set of beer and beverage equipment comprises the draft beer machine's main structure, casks, keg spears, distributors, pressure gauges, hoses, beer towers, beer labels and beer taps. Beer or beverage is stored in the cask or other containers, drawn through the keg spears, distributors, pressure gauges and hoses, refrigerated by the draft beer machine, and then discharged from the beer tap through the beer tower.

Existing draft beer machines achieves refrigeration by the means of air cooling or water cooling. The air cooling method needs to refrigerate beer casks in a cold storage box for over 10 hours before it can be served. It takes a long time to wait. However, the water cooling method needs to pre-cool water in the water tank in advance, and the pre-cooling process also spends over 10 hours before beer can be served normally.

SUMMARY OF THE INVENTION

In respect to the technical issues stated above in the prior art, the present invention provides a double cooled draft beer machine. One technical issue to be resolved by one embodiment of the double cooled draft beer machine is how to quickly refrigerate the beer from at a normal temperature to a serviceable state, improve the refrigeration effect, and ensures the beer can always flow out at a relatively low temperature.

One objective of one embodiment of the present invention can be achieved by the following proposal:

A double cooled draft beer machine comprises a cabinet, and there is a refrigeration circuit inside the cabinet, including a compressor, a condenser, and an evaporator. Inside the cabinet, there is a cold storage chamber used to hold the cask, and the evaporator can refrigerate the cold storage chamber. A beer pipe and a refrigeration tube which can refrigerate the beer pipe are also arranged inside the cabinet, and a beer tap is fixed to the outside of the cabinet. The outer end of the beer pipe is connected to the beer tap, and its inner end is used to connect to the cask. It is characterized in that:

The refrigeration tube is connected to the refrigeration circuit and in parallel with the evaporator. In the refrigeration circuit, at least one solenoid valve is set up, which is used to open or close the refrigeration circuit for the refrigerant to flow toward the refrigeration tube or the evaporator. The present double cooled draft beer machine also comprises a relay used to control the action of the solenoid valve and the first thermostat used to detect the temperature. The detection point of the first thermostat is located between the refrigeration tube and the beer pipe. The first thermostat is in series with the relay, and the contacts of the relay are connected to the solenoid of the solenoid valve, as well as the compressor. When the temperature detected by the first thermostat is higher than the first upper limit temperature threshold set by the first thermostat, the relay controls the solenoid valve to allow the refrigerant in the refrigeration circuit to stop flowing toward the evaporator, instead, to flow toward the refrigeration tube only. When the temperature detected by the first thermostat is equal to or lower than the first lower limit temperature threshold set by the first thermostat, the relay controls the solenoid valve to allow the refrigerant in the refrigeration circuit to stop flowing toward the refrigeration tube.

The present double cooled draft beer machine comprises a refrigeration circuit including the compressor, the condenser and the evaporator, and the refrigeration tube is connected to the refrigeration circuit and in parallel with the evaporator. This affords two refrigeration modes, firstly, the evaporator can refrigerate the casks in the cold storage chamber, and secondly, the refrigeration tube can refrigerate the beer pipe. After the present double cooled draft beer machine is powered on, it always refrigerates the refrigeration tube first, so as to ensure beer can always flow out at a relatively low temperature. The first upper limit temperature threshold and the first lower limit temperature threshold are set on the first thermostat. The temperature detected by the first thermostat can be either the temperature of the beer pipe or the temperature of the refrigeration tube. When a temperature conductive medium such as the temperature conductive mud is arranged between the refrigeration tube and the beer pipe, the temperature detected by the first thermostat may also be the temperature of the temperature conductive mud. After the draft beer machine is powered on, when the temperature detected by the first thermostat is higher than the first upper limit temperature threshold set by the first thermostat, it is indicated that the beer temperature in the beer pipe is relatively high and the drinking flavor is affected. At this point, the switch of the first thermostat is closed, making the solenoid valve to act and switch the flowing direction of the refrigerant to allow the refrigerant in the refrigeration circuit to stop flowing toward the evaporator, instead, to flow toward the refrigeration tube only. When it flows toward the refrigeration tube, the temperature of the refrigeration tube decreases, then the beer pipe is refrigerated and the temperature of inflowing beer decreases. When the temperature detected by the first thermostat is equal to or lower than the first lower limit temperature threshold set by the first thermostat, it is indicated that beer in the beer pipe is suitable for people to drink. The switch of the first thermostat is off, having the solenoid valve power off and allowing the refrigerant in the refrigeration circuit to stop flowing toward the refrigeration tube. The analysis of the temperature detected by the first thermostat always takes precedence, no matter when the refrigerant is flowing toward the evaporator, or when the compressor is powered off. By the means stated above, the refrigeration tube can refrigerate the beer pipe and beer quickly. After the cask at the normal temperature is placed in the machine, beer can be drunk immediately.

In the double cooled draft beer machine, the second thermostat which can detect the inner temperature of the cold storage chamber is arranged inside the cold storage chamber. The second thermostat is in parallel with a series branch consisting of the first thermostat and the relay. When the temperature detected by the first thermostat is equal to or lower than the first lower limit temperature threshold, and the inner temperature of the cold storage chamber is higher than the second upper limit temperature threshold set by the second thermostat, the relay controls the solenoid valve to allow the refrigerant in the refrigeration circuit to flow toward the evaporator. When the temperature detected by the first thermostat is equal to or lower than the first lower limit temperature threshold, and the inner temperature of the cold storage chamber is equal to or lower than the second lower limit temperature threshold set by the second thermostat, the second thermostat switches off and makes the compressor stop working. The second thermostat detects the temperature of the cold storage chamber. Only after the refrigeration to the refrigeration tube is fulfilled, the cold storage chamber will be refrigerated. When the temperature detected by the first thermostat increases to above the first upper limit temperature threshold, even if the second thermostat is controlling the refrigerant in the refrigeration circuit to flow toward the evaporator, the refrigerant will be switched to flowing toward the refrigeration tube to first fulfill the refrigeration to the beer pipe, so as to ensure that beer can always flow out at a relatively low temperature. When the temperature detected by the first thermostat and the temperature of the cold storage chamber are equal to or lower than the given first lower limit temperature threshold and the given second lower limit temperature threshold respectively, the second thermostat switches off and interrupts the power supply of the compressor and makes it stop working.

In the double cooled draft beer machine, the current input of the electromagnetic coil of the relay and the contact of the relay are connected to one end of the first thermostat, and the other end of the first thermostat is connected to a power supply. The current output of the electromagnetic coil of the relay is connected to the power supply to form a circuit. The other contact of the relay is connected to the current input of the solenoid valve and the current input of the compressor respectively. The current output of the solenoid valve and the current output of the compressor are connected to the power supply. One end of the second thermostat is connected to the power supply, and the other end is connected to the current input of the compressor. When the switch of the first thermostat is closed, the electromagnetic coil of the relay is energized to close and connect the contact, having the solenoid valve to be powered on and act, to switch the flowing direction of the refrigerant to flow toward the beer pipe only. When the switch of the first thermostat is off, the contact of the relay is opened and hence the solenoid valve is powered off, and the solenoid valve allows the refrigerant to flow toward the evaporator. At this point, when the switch of the second thermostat is also opened, the circuit between the compressor and the power supply opens and the compressor stops working.

In the double cooled draft beer machine, the refrigeration tube and the beer pipe are wound into a quick cooler of a round or an elliptic cylindrical shape, in a helical manner. The quick cooler comprises at least one mixing layer, which is formed by winding the refrigeration tube and the beer pipe into a round or elliptic cylindrical shape, in an abreast and helical manner. The inflowing direction of the beer pipe is opposite the flowing direction of the refrigerant in the refrigeration tube. The first thermostat is arranged on the quick cooler and the detection point of the first thermostat is close to the outlet end of the beer pipe.

With the arrangement of the quick cooler, the beer pipe and the refrigeration tube adhere tightly and then the cooling capacity is transferred between the refrigeration tube and the beer pipe in the form of dry contact cooling. Also, compared to water cooling, dry contact cooling has an advantage of high speed of cooling capacity transfer, and can further expedite the refrigeration process to achieve a quick cooling effect, so as to fulfill the purpose of quick cooling of beer. The quick cooler may be round or elliptic cylindrical. Both shapes can present smooth bends on the refrigeration tubes and the beer pipes. This ensures that the fluid in the beer pipes and the refrigeration tubes flows fluently, can further ensure a uniform distribution of cooling capacity to improve the refrigeration speed, and prevents the tubes from being clogged by ice due to non-uniform local cooling capacity. The arranged location of the first thermostat makes the detection result more accurate. The flowing direction of the fluid in the beer pipe is opposite that of the fluid in the refrigeration tube. The refrigerant at a relatively low temperature in the refrigeration tube transfers the cooling capacity to beer at a higher temperature in the beer pipe. Such an arrangement ensures a long refrigeration time of the beer and improves the refrigeration efficiency.

In the double cooled draft beer machine, a mounting cover is also arranged on the top of the cold storage chamber. The mounting cover is fixed to the inner wall of the cabinet, and the evaporator is arranged inside mounting cover. On the mounting cover, there is also an evaporator blower which can blow the cold air diffused from the evaporator into the cold storage chamber. After the evaporator fulfills the refrigeration, the refrigeration area and speed are increased by the evaporator blower, and the cold storage chamber is refrigerated quickly, so as to refrigerate the casks. The arrangement of the mounting cover is convenient for the arrangements of the second thermostat and the evaporator blower.

In the double cooled draft beer machine, the solenoid valve is a 3-way solenoid valve. The inlet of the 3-way solenoid valve is connected to the refrigerant outlet of the condenser, one outlet of the 3-way solenoid valve is connected to the refrigeration tube, and the other outlet is connected to the evaporator. The 3-way solenoid valve has one inlet and two outlets. When the 3-way solenoid valve is powered on, the inlet is connected to the outlet which is connected to the refrigeration tube. When it is powered off, the inlet is connected to the outlet which is connected to the evaporator.

In the double cooled draft beer machine, there are two solenoid valves: the first solenoid valve and the second solenoid valve. The inlet of the first solenoid valve is connected to the refrigerant outlet of the condenser, and the outlet is connected to the refrigeration tube. The inlet of the second solenoid valve is connected to the refrigerant outlet of the condenser, and the outlet is connected to the evaporator. The relay has both a normally open contact and a normally closed contact. The normally open contact is connected to the first solenoid valve and the normally closed contact is connected to the second solenoid valve. When the relay is powered on, the normally closed contact will be disconnected to switch off the second solenoid valve, and the normally open contact is on to switch on the first solenoid valve, so the refrigerant flow toward the refrigeration tube only.

A double cooled draft beer machine comprises a cabinet, and there is a refrigeration circuit inside the cabinet, including a compressor, a condenser, and an evaporator. Inside the cabinet, there is a cold storage chamber used to hold the cask, and the evaporator can refrigerate the cold storage chamber. A beer pipe and a refrigeration tube which can refrigerate the beer pipe are also arranged inside the cabinet, and a beer tap is fixed to the outside of the cabinet. The outer end of the beer pipe is connected to the beer tap, and its inner end is used to connect to the cask. It is characterized in that:

The refrigeration tube is connected to the refrigeration circuit and in parallel with the evaporator. In the refrigeration circuit, at least one solenoid valve is set up, which is used to open or close the refrigeration circuit for the refrigerant to flow toward the refrigeration tube or the evaporator. The present double cooled draft beer machine also comprises a control chip used to control the action of the solenoid valve and the first temperature sensor used to detect the temperature. The detection point of the first temperature sensor is located between the refrigeration tube and the beer pipe. The first temperature sensor is connected to the input end of the control chip, the solenoid valve is connected to the output end of the control chip, and a relay used to control the on-off operation of the compressor is also connected to the output end of the control chip. The first upper limit temperature threshold and the first lower limit temperature threshold of the beer pipe are set inside the control chip. When the temperature detected by the first temperature sensor is higher than the first upper limit temperature threshold, the control chip controls the solenoid valve to act and switch on the compressor to allow the refrigerant to stop flowing toward the evaporator, instead, to flow toward the refrigeration tube only. When the temperature detected by the first temperature sensor is equal to or lower than the first lower limit temperature threshold, the control chip controls the solenoid valve to act to allow the refrigerant in the refrigeration circuit to stop flowing toward the refrigeration tube.

The present double cooled draft beer machine comprises a refrigeration circuit including the compressor, the condenser and the evaporator, and the refrigeration tube is connected to the refrigeration circuit and in parallel with the evaporator. This enables two refrigeration modes, firstly, the evaporator can refrigerate the casks in the cold storage chamber, and secondly, the refrigeration tube can refrigerate the beer pipe. After the present double cooled draft beer machine is powered on, it always refrigerates the refrigeration tube first, so as to ensure beer can always flow out at a relatively low temperature. The first upper limit temperature threshold and the first lower limit temperature threshold of the beer pipe are set in the control chip. The temperature detected by the first temperature sensor may be the temperature of the beer pipe or the temperature of the refrigeration tube. When a temperature conductive medium, such as the temperature conductive mud, is arranged between the refrigeration tube and the beer pipe, the temperature detected by the first temperature sensor may also be the temperature of the temperature conductive mud. After the draft beer machine is powered on, when the temperature detected by the first temperature sensor is higher than the first upper limit temperature threshold set by control chip, it is indicated that the temperature of beer passing through the beer pipe is relatively high and the drinking flavor is affected. At this point, the control chip controls the operation of the compressor by the relay, and controls the solenoid valve to act. The solenoid valve switches the flowing direction of the refrigerant, and the refrigerant in the refrigeration circuit stops flowing toward the evaporator, instead, flowing toward the refrigeration tube only. When it flows toward the refrigeration tube, the temperature of the refrigeration tube decreases, then the beer pipe is refrigerated and the temperature of inflowing beer decreases. When the temperature detected by the first temperature sensor is equal to or lower than the first lower limit temperature threshold, the control chip controls the solenoid valve to act and allow the refrigerant to stop flowing toward the refrigeration tube. The temperature detected by the first temperature sensor always takes precedence, no matter when the refrigerant is flowing toward the evaporator, or when the compressor is powered off.

In the double cooled draft beer machine, the present double cooled draft beer machine also comprises the second temperature sensor to detect the inner temperature of the cold storage chamber. The second temperature sensor is connected to the input end of the control chip, and the second upper limit temperature threshold and the second lower limit temperature threshold of the cold storage chamber are set inside the control chip. When the temperature detected by the first temperature sensor is equal to or lower than the first lower limit temperature threshold, and the inner temperature of the cold storage chamber is higher than the second upper limit temperature threshold, the control chip controls the solenoid valve to act and switches on the compressor to allow the refrigerant to flow toward the evaporator. When the temperature detected by the first temperature sensor is equal to or lower than the first lower limit temperature threshold, and the inner temperature of the cold storage chamber is equal to or lower than the second lower limit temperature threshold, the control chip controls the relay to switch off the compressor and make it stop working. The second temperature sensor detects the temperature of the cold storage chamber. Only after the refrigeration to the refrigeration tube is fulfilled, the cold storage chamber will be refrigerated. When the temperature detected by the first temperature sensor increases to above the first upper limit temperature threshold, even if the control chip is controlling the refrigerant in the refrigeration circuit to flow toward the evaporator, the refrigerant will be switched to flowing toward the refrigeration tube to first fulfill the refrigeration to the beer pipe, so as to ensure that beer can always flow out at a relatively low temperature. When the temperature detected by the first temperature sensor and the temperature of the cold storage chamber are equal to or lower than the given first lower limit temperature threshold and the given second lower limit temperature threshold respectively, the control chip controls the relay to switch off and interrupt the power supply of the compressor, and the compressor stops working.

In the double cooled draft beer machine, the electromagnetic coil of the relay is connected to output end of the control chip, and the normally open contact of the relay is connected to between the compressor and the power supply of the compressor. The relay is switched on or off according to the electronic signals sent by the control chip, and hence controls the on-off operation between the compressor and the power supply.

In the double cooled draft beer machine, the refrigeration tube and the beer pipe are wound into a quick cooler of a round or an elliptic cylindrical shape, in a helical manner. The quick cooler comprises at least one mixing layer, which is formed by winding the refrigeration tube and the beer pipe into a round or elliptic cylindrical shape, in an abreast and helical manner. The inflowing direction of the beer pipe is opposite the flowing direction of the refrigerant in the refrigeration tube. The first temperature sensor is arranged on the quick cooler and the detection point of the first temperature sensor is close to the outlet end of the beer pipe.

With the arrangement of the quick cooler, the beer pipe and the refrigeration tube adhere tightly and then the cooling capacity is transferred between the refrigeration tube and the beer pipe in the form of dry contact cooling. Also, compared to water cooling, dry contact cooling has an advantage of high speed of cooling capacity transfer, and can further expedite the refrigeration process to achieve a quick cooling effect, so as to fulfill the purpose of quick cooling of beer. The quick cooler may be round or elliptic cylindrical. Both shapes can present smooth bends on the refrigeration tubes and the beer pipes. This ensures that the fluid in the beer pipes and the refrigeration tubes flows fluently, can further ensure a uniform distribution of cooling capacity to improve the refrigeration speed, and prevents the tubes from being clogged by ice due to non-uniform local cooling capacity. The arranged location of the first temperature sensor makes the detection result more accurate. The flowing direction of the fluid in the beer pipe is opposite that of the fluid in the refrigeration tube. The refrigerant at a relatively low temperature in the refrigeration tube transfers the cooling capacity to beer at a higher temperature in the beer pipe. Such an arrangement ensures a long refrigeration time of the beer and improves the refrigeration efficiency.

In the double cooled draft beer machine, a mounting cover is also arranged on the top of the cold storage chamber. The mounting cover is fixed to the inner wall of the cabinet, and the evaporator is arranged inside mounting cover. On the mounting cover, there is also an evaporator blower which can blow the cold air diffused from the evaporator into the cold storage chamber. After the evaporator fulfills the refrigeration, the refrigeration area and speed are increased by the evaporator blower, and the cold storage chamber is refrigerated quickly, so as to refrigerate the casks. The arrangement of the mounting cover is convenient for the arrangements of the second temperature sensor and the blower.

In the double cooled draft beer machine, the solenoid valve is a 3-way solenoid valve. The inlet of the 3-way solenoid valve is connected to the refrigerant outlet of the condenser, one outlet of the 3-way solenoid valve is connected to the refrigeration tube, and the other outlet is connected to the evaporator. The 3-way solenoid valve has one inlet and two outlets. When the 3-way solenoid valve is powered on, the inlet is connected to the outlet which is connected to the refrigeration tube. When it is powered off, the inlet is connected to the outlet which is connected to the evaporator.

In the double cooled draft beer machine, there are two solenoid valves: the first solenoid valve and the second solenoid valve. The inlet of the first solenoid valve is connected to the refrigerant outlet of the condenser, and the outlet is connected to the refrigeration tube. The inlet of the second solenoid valve is connected to the refrigerant outlet of the condenser, and the outlet is connected to the evaporator. The control chip controls the on-off operation of the first solenoid valve and the second solenoid valve respectively. When the first solenoid valve is switched on, the second solenoid valve is switched off.

A double cooled draft beer machine comprises a cabinet, and there is a refrigeration circuit inside the cabinet, including a compressor, a condenser, and an evaporator. Inside the cabinet, there is a cold storage chamber used to hold the cask, and the evaporator can refrigerate the cold storage chamber. A beer pipe and a refrigeration tube which can refrigerate the beer pipe are also arranged inside the cabinet, and a beer tap is fixed to the outside of the cabinet. The outer end of the beer pipe is connected to the beer tap, and its inner end is used to connect to the cask. It is characterized in that:

The refrigeration tube is connected to the refrigeration circuit and in parallel with the evaporator. In the refrigeration circuit, at least one solenoid valve is set up, which is used to open or close the refrigeration circuit for the refrigerant to flow toward the refrigeration tube or the evaporator. The present double cooled draft beer machine also comprises a microprocessor used to control the action of the solenoid valve, a flow sensor used to detect the beer flow of the beer pipe, a relay used to the control the on-off operation of the compressor, and the first temperature sensor used to detect the temperature. The detection point of the first temperature sensor is located between the refrigeration tube and the beer pipe, and there is a timer inside the microprocessor. The flow sensor and the first temperature sensor are connected to the input end of the microprocessor respectively, and the solenoid valve and the relay are connected to the output end of the microprocessor respectively. The first lower limit temperature threshold is set inside the microprocessor. When a flow passes through the beer pipe, the timer starts timing. Within the timing interval set by the microprocessor, when the beer flow in the beer pipe reaches the flow threshold set by the microprocessor, the microprocessor controls the solenoid valve to act and switches on the compressor to allow the refrigerant to stop flowing toward the evaporator, instead, to flow toward the refrigeration tube only. When the temperature detected by the first temperature sensor is equal to or lower than the first lower limit temperature threshold, the microprocessor controls the solenoid valve to act to allow the refrigerant in the refrigeration circuit to stop flowing toward the refrigeration tube.

The present double cooled draft beer machine comprises a refrigeration circuit including the compressor, the condenser and the evaporator, and the refrigeration tube is connected to the refrigeration circuit and in parallel with the evaporator. This affords two refrigeration modes, firstly, the evaporator can refrigerate the casks in the cold storage chamber, and secondly, the refrigeration tube can refrigerate the beer pipe. After the present double cooled draft beer machine is powered on, it always refrigerates the refrigeration tube first, so as to ensure beer can always flow out at a relatively low temperature. The first lower limit temperature threshold of the beer pipe is set in the microprocessor. The temperature detected by the first temperature sensor may be the temperature of the beer pipe or the temperature of the refrigeration tube. When a temperature conductive medium, such as the temperature conductive mud, is arranged between the refrigeration tube and the beer pipe, the temperature detected by the first temperature sensor may also be the temperature of the temperature conductive mud. The flow sensor detects the flow in the beer pipe and sends the result to the microprocessor. When flow exists in the beer pipe, the timer starts timing. During the given timing interval, when the flow reaches the flow threshold, it is indicated that much beer is discharged during a short period. This would take away the cooling capacity in the refrigeration tube, makes the temperature of the refrigeration tube increase quickly, and at the meanwhile, the temperature of the beer pipe also increases. At this point, the microprocessor controls the solenoid valve to act and switches on the compressor, allowing the refrigerant to stop flowing toward the evaporator, instead, to flow toward the refrigeration tube only. When it flows toward the refrigeration tube, the temperature of the refrigeration tube decreases, then the beer pipe is refrigerated and the temperature of inflowing beer decreases. By the actions stated above, it can be predicted in advance that the temperature of the beer pipe will be quite lower, and hence refrigeration is executed in advance, to ensure beer can always flow out at a relatively low temperature. When the temperature detected by the first temperature sensor (20) is equal to or lower than the first lower limit temperature threshold, the microprocessor (28) controls the solenoid valve to act to allow the refrigerant in the refrigeration circuit to stop flowing toward the refrigeration tube (8). The analysis of the beer flow of the beer pipe always takes precedence, no matter when the refrigerant is flowing toward the evaporator, or when the compressor is powered off.

In the double cooled draft beer machine, the second temperature sensor which can detect the inner temperature of the cold storage chamber is arranged inside the cold storage chamber. The second temperature sensor is connected to the input end of the microprocessor, and the second lower limit temperature threshold is set inside the microprocessor. When the temperature detected by the first temperature sensor is equal to or lower than the first lower limit temperature threshold, the microprocessor controls the solenoid valve to act and switches on the compressor to allow the refrigerant to flow toward the evaporator. When the temperature detected by the first temperature sensor is equal to or lower than the first lower limit temperature threshold, and the inner temperature of the cold storage chamber is equal to or lower than the second lower limit temperature threshold, the microprocessor controls the relay to switch off the compressor and make it stop working. The second temperature sensor detects the temperature of the cold storage chamber. Only after the refrigeration to the refrigeration tube is fulfilled, the cold storage chamber will be refrigerated. Within the given timing interval, and when the flow in the beer pipe reaches the flow threshold, even if the microprocessor is controlling the refrigerant in the refrigeration circuit to flow toward the evaporator, the refrigerant will be switched to flowing toward the refrigeration tube to first fulfill the refrigeration to the beer pipe, so as to ensure that beer can always flow out at a relatively low temperature. When the refrigeration condition under which the refrigerant flows toward the refrigeration tube is not met, and the temperature of the cold storage chamber is equal to or lower than the given second lower limit temperature threshold, the microprocessor controls the relay to switch off and interrupt the power supply of the compressor, and the compressor stops working.

In the double cooled draft beer machine, the electromagnetic coil of the relay is connected to output end of the microprocessor, and the normally open contact of the relay is connected to between the compressor and the power supply of the compressor. The relay is switched on or off according to the electronic signals sent by the microprocessor, and hence controls the on-off operation between the compressor and the power supply.

In the double cooled draft beer machine, the flow sensor is arranged on the beer pipe, next to the beer tap. Such an arrangement of the flow sensor makes the detection signals more accurate, and is convenient for the microprocessor to execute the further control work.

In the double cooled draft beer machine, the refrigeration tube and the beer pipe are wound into a quick cooler of a round or an elliptic cylindrical shape, in a helical manner. The quick cooler comprises at least one mixing layer, which is formed by winding the refrigeration tube and the beer pipe into a round or elliptic cylindrical shape, in an abreast and helical manner. The inflowing direction of the beer pipe is opposite the flowing direction of the refrigerant in the refrigeration tube. The first temperature sensor is arranged on the quick cooler and the detection point of the first temperature sensor is close to the outlet end of the beer pipe.

With the arrangement of the quick cooler, the beer pipe and the refrigeration tube adhere tightly and then the cooling capacity is transferred between the refrigeration tube and the beer pipe in the form of dry contact cooling. Also, compared to water cooling, dry contact cooling has an advantage of high speed of cooling capacity transfer, and can further expedite the refrigeration process to achieve a quick cooling effect, so as to fulfill the purpose of quick cooling of beer. The quick cooler may be round or elliptic cylindrical. Both shapes can present smooth bends on the refrigeration tubes and the beer pipes. This ensures that the fluid in the beer pipes and the refrigeration tubes flows fluently, can further ensure a uniform distribution of cooling capacity to improve the refrigeration speed, and prevents the tubes from being clogged by ice due to non-uniform local cooling capacity. The arranged location of the first temperature sensor makes the detection result more accurate. The flowing direction of the fluid in the beer pipe is opposite that of the fluid in the refrigeration tube. The refrigerant at a relatively low temperature in the refrigeration tube transfers the cooling capacity to beer at a higher temperature in the beer pipe. Such an arrangement ensures a long refrigeration time of the beer and improves the refrigeration efficiency.

In the double cooled draft beer machine, a mounting cover is also arranged on the top of the cold storage chamber. The mounting cover is fixed to the inner wall of the cabinet, and the evaporator is arranged inside mounting cover. On the mounting cover, there is also an evaporator blower which can blow the cold air diffused from the evaporator into the cold storage chamber. After the evaporator fulfills the refrigeration, the refrigeration area and speed are increased by the evaporator blower, and the cold storage chamber is refrigerated quickly, so as to refrigerate the casks. The arrangement of the mounting cover is convenient for the arrangements of the second temperature sensor and the blower.

In the double cooled draft beer machine, the solenoid valve is a 3-way solenoid valve. The inlet of the 3-way solenoid valve is connected to the refrigerant outlet of the condenser, one outlet of the 3-way solenoid valve is connected to the refrigeration tube, and the other outlet is connected to the evaporator. The 3-way solenoid valve has one inlet and two outlets. When the 3-way solenoid valve is powered on, the inlet is connected to the outlet which is connected to the refrigeration tube. When it is powered off, the inlet is connected to the outlet which is connected to the evaporator.

In the double cooled draft beer machine, there are two solenoid valves: the first solenoid valve and the second solenoid valve. The inlet of the first solenoid valve is connected to the refrigerant outlet of the condenser, and the outlet is connected to the refrigeration tube. The inlet of the second solenoid valve is connected to the refrigerant outlet of the condenser, and the outlet is connected to the evaporator. The microprocessor controls the on-off operation of the first solenoid valve and the second solenoid valve respectively. When the first solenoid valve is switched on, the second solenoid valve is switched off.

A double cooled draft beer machine comprises a cabinet, and there is a refrigeration circuit inside the cabinet, including a compressor, a condenser, and an evaporator. Inside the cabinet, there is a cold storage chamber used to hold the cask, and the evaporator can refrigerate the cold storage chamber. A beer pipe and a refrigeration tube which can refrigerate the beer pipe are also arranged inside the cabinet, and a beer tap is fixed to the outside of the cabinet. The outer end of the beer pipe is connected to the beer tap, and its inner end is used to connect to the cask. It is characterized in that:

The refrigeration tube is connected to the refrigeration circuit and in parallel with the evaporator. In the refrigeration circuit, at least one solenoid valve is set up, which is used to open or close the refrigeration circuit for the refrigerant to flow toward the refrigeration tube or the evaporator. The present double cooled draft beer machine also comprises a microprocessor used to control the action of the solenoid valve and the first temperature sensor used to detect the temperature. The detection point of the first temperature sensor is located between the refrigeration tube and the beer pipe. A stroke switch, which will be switched on when beer is discharged from the beer tap, is arranged on the beer tap, and the stroke switch is connected to the input end of the microprocessor. There is a timer inside the microprocessor. The stroke switch and the first temperature sensor are connected to the input end of the microprocessor respectively, the solenoid valve is connected to the output end of the microprocessor, and a relay used to control the on-off operation of the compressor is also connected to the output end of the microprocessor. The first lower limit temperature threshold is set inside the microprocessor. When the stroke switch is switches on, the timer starts timing. When the recorded time is longer than the timing interval threshold set by the microprocessor, the microprocessor controls the solenoid valve to act and switches on the compressor to allow the refrigerant to stop flowing toward the evaporator, instead, to flow toward the refrigeration tube only. When the temperature detected by the first temperature sensor is equal to or lower than the first lower limit temperature threshold, the microprocessor controls the solenoid valve to act to allow the refrigerant in the refrigeration circuit to stop flowing toward the refrigeration tube.

The present double cooled draft beer machine comprises a refrigeration circuit including the compressor, the condenser and the evaporator, and the refrigeration tube is connected to the refrigeration circuit and in parallel with the evaporator. This affords two refrigeration modes, firstly, the evaporator can refrigerate the casks in the cold storage chamber, and secondly, the refrigeration tube can refrigerate the beer pipe. After the present double cooled draft beer machine is powered on, it always refrigerates the refrigeration tube first, so as to ensure beer can always flow out at a relatively low temperature. The temperature detected by the first temperature sensor may be the temperature of the beer pipe or the temperature of the refrigeration tube. When a temperature conductive medium, such as the temperature conductive mud, is arranged between the refrigeration tube and the beer pipe, the temperature detected by the first temperature sensor may also be the temperature of the temperature conductive mud. The first lower limit temperature threshold of the beer pipe is set in the microprocessor. When the beer tap opens, the stroke switch is closed, electronic signals are sent to the microprocessor, and the microprocessor starts timing with the timer. When the recorded time is longer than the timing interval threshold set by the microprocessor, it is indicated that much beer is discharged during a short period. This would take away the cooling capacity in the refrigeration tube, makes the temperature of the refrigeration tube increase quickly, and at the meanwhile, the temperature of the beer pipe also increases. At this point, the microprocessor controls the solenoid valve to act and switches on the compressor, allowing the refrigerant to stop flowing toward the evaporator, instead, to flow toward the refrigeration tube only. When it flows toward the refrigeration tube, the temperature of the refrigeration tube decreases, then the beer pipe is refrigerated and the temperature of inflowing beer decreases. By the actions stated above, it can be predicted in advance that the temperature of the beer pipe will be quite lower, and hence refrigeration is executed in advance, to ensure beer can always flow out at a relatively low temperature. When the temperature detected by the first temperature sensor (20) is equal to or lower than the first lower limit temperature threshold, the microprocessor (28) controls the solenoid valve to act to allow the refrigerant in the refrigeration circuit to stop flowing toward the refrigeration tube (8). The analysis of the beer discharging time of the beer pipe always takes precedence, no matter when the refrigerant is flowing toward the evaporator, or when the compressor is powered off.

In the double cooled draft beer machine, the second temperature sensor which can detect the inner temperature of the cold storage chamber is arranged inside the cold storage chamber. The second temperature sensor is connected to the input end of the microprocessor, and the second lower limit temperature threshold is set inside the microprocessor. When the temperature detected by the first temperature sensor is equal to or lower than the first lower limit temperature threshold, the microprocessor controls the solenoid valve to act and switches on the compressor to allow the refrigerant to flow toward the evaporator. When the temperature detected by the first temperature sensor is equal to or lower than the first lower limit temperature threshold, and the inner temperature of the cold storage chamber is equal to or lower than the second lower limit temperature threshold, the microprocessor controls the relay to switch off the compressor and make it stop working. The second temperature sensor detects the temperature of the cold storage chamber. Only after the refrigeration to the refrigeration tube is fulfilled, the cold storage chamber will be refrigerated. When the beer discharging time of the beer tap exceeds the given timing interval threshold, even if the microprocessor is controlling the refrigerant in the refrigeration circuit to flow toward the evaporator, the refrigerant will be switched to flowing toward the refrigeration tube to first fulfill the refrigeration to the beer pipe, so as to ensure that beer can always flow out at a relatively low temperature. When the refrigeration condition under which the refrigerant flows toward the refrigeration tube is not met, and the temperature of the cold storage chamber is equal to or lower than the given second lower limit temperature threshold, the microprocessor controls the relay to switch off and interrupt the power supply of the compressor, and the compressor stops working.

In the double cooled draft beer machine, the electromagnetic coil of the relay is connected to output end of the microprocessor, and the normally open contact of the relay is connected to between the compressor and the power supply of the compressor. The relay is switched on or off according to the electronic signals sent by the microprocessor, and hence controls the on-off operation between the compressor and the power supply.

In the double cooled draft beer machine, the refrigeration tube and the beer pipe are wound into a quick cooler of a round or an elliptic cylindrical shape, in a helical manner. The quick cooler comprises at least one mixing layer, which is formed by winding the refrigeration tube and the beer pipe into a round or elliptic cylindrical shape, in an abreast and helical manner. The inflowing direction of the beer pipe is opposite the flowing direction of the refrigerant in the refrigeration tube. The first temperature sensor is arranged on the quick cooler and the detection point of the first temperature sensor is close to the outlet end of the beer pipe.

With the arrangement of the quick cooler, the beer pipe and the refrigeration tube adhere tightly and then the cooling capacity is transferred between the refrigeration tube and the beer pipe in the form of dry contact cooling. Also, compared to water cooling, dry contact cooling has an advantage of high speed of cooling capacity transfer, and can further expedite the refrigeration process to achieve a quick cooling effect, so as to fulfill the purpose of quick cooling of beer. The quick cooler may be round or elliptic cylindrical. Both shapes can present smooth bends on the refrigeration tubes and the beer pipes. This ensures that the fluid in the beer pipes and the refrigeration tubes flows fluently, can further ensure a uniform distribution of cooling capacity to improve the refrigeration speed, and prevents the tubes from being clogged by ice due to non-uniform local cooling capacity. The arranged location of the first temperature sensor makes the detection result more accurate. The flowing direction of the fluid in the beer pipe is opposite that of the fluid in the refrigeration tube. The refrigerant at a relatively low temperature in the refrigeration tube transfers the cooling capacity to beer at a higher temperature in the beer pipe. Such an arrangement ensures a long refrigeration time of the beer and improves the refrigeration efficiency.

In the double cooled draft beer machine, a mounting cover is also arranged on the top of the cold storage chamber. The mounting cover is fixed to the inner wall of the cabinet, and the evaporator is arranged inside mounting cover. On the mounting cover, there is also an evaporator blower which can blow the cold air diffused from the evaporator into the cold storage chamber. After the evaporator fulfills the refrigeration, the refrigeration area and speed are increased by the evaporator blower, and the cold storage chamber is refrigerated quickly, so as to refrigerate the casks. The arrangement of the mounting cover is convenient for the arrangements of the second temperature sensor and the evaporator blower.

In the double cooled draft beer machine, the solenoid valve is a 3-way solenoid valve. The inlet of the 3-way solenoid valve is connected to the refrigerant outlet of the condenser, one outlet of the 3-way solenoid valve is connected to the refrigeration tube, and the other outlet is connected to the evaporator. The 3-way solenoid valve has one inlet and two outlets. When the 3-way solenoid valve is powered on, the inlet is connected to the outlet which is connected to the refrigeration tube. When it is powered off, the inlet is connected to the outlet which is connected to the evaporator.

In the double cooled draft beer machine, there are two solenoid valves: the first solenoid valve and the second solenoid valve. The inlet of the first solenoid valve is connected to the refrigerant outlet of the condenser, and the outlet is connected to the refrigeration tube. The inlet of the second solenoid valve is connected to the refrigerant outlet of the condenser, and the outlet is connected to the evaporator. The microprocessor controls the on-off operation of the first solenoid valve and the second solenoid valve respectively. When the first solenoid valve is switched on, the second solenoid valve is switched off.

Compared to the prior art, one embodiment of the present invention has the following advantages:

1. After the present invention is powered on, it always refrigerates the beer pipe first. After the refrigeration to the beer pipe is completed, the cold storage chamber is then refrigerated. When the beer pipe needs refrigeration, the refrigeration to the cold storage chamber will be stopped immediately, and the beer pipe will be refrigerated first, so as to ensure that beer can always flow out at a relatively low temperature.

2. In the present invention, the refrigeration tube and the beer pipe are wound into a quick cooler of a round or an elliptic cylindrical shape, in a helical manner. The beer pipe is refrigerated quickly by the means of dry contact cooling, which improves the refrigeration efficiency.

3. In the present invention, the flowing direction of the fluid in the beer pipe is opposite that of the fluid in the refrigeration tube. The refrigerant at a relatively low temperature in the refrigeration tube transfers the cooling capacity to beer at a higher temperature in the beer pipe. Such an arrangement ensures a long refrigeration time of the beer and improves the refrigeration efficiency.

4. In the present invention, the refrigeration tube can refrigerate the beer pipe and beer quickly. After the cask at the normal temperature is placed in the machine, beer can be drunk immediately. When no beer is discharged, the cold storage chamber refrigerates the cask in advance.

DETAILED DESCRIPTION OF THE INVENTION

Figure 1:
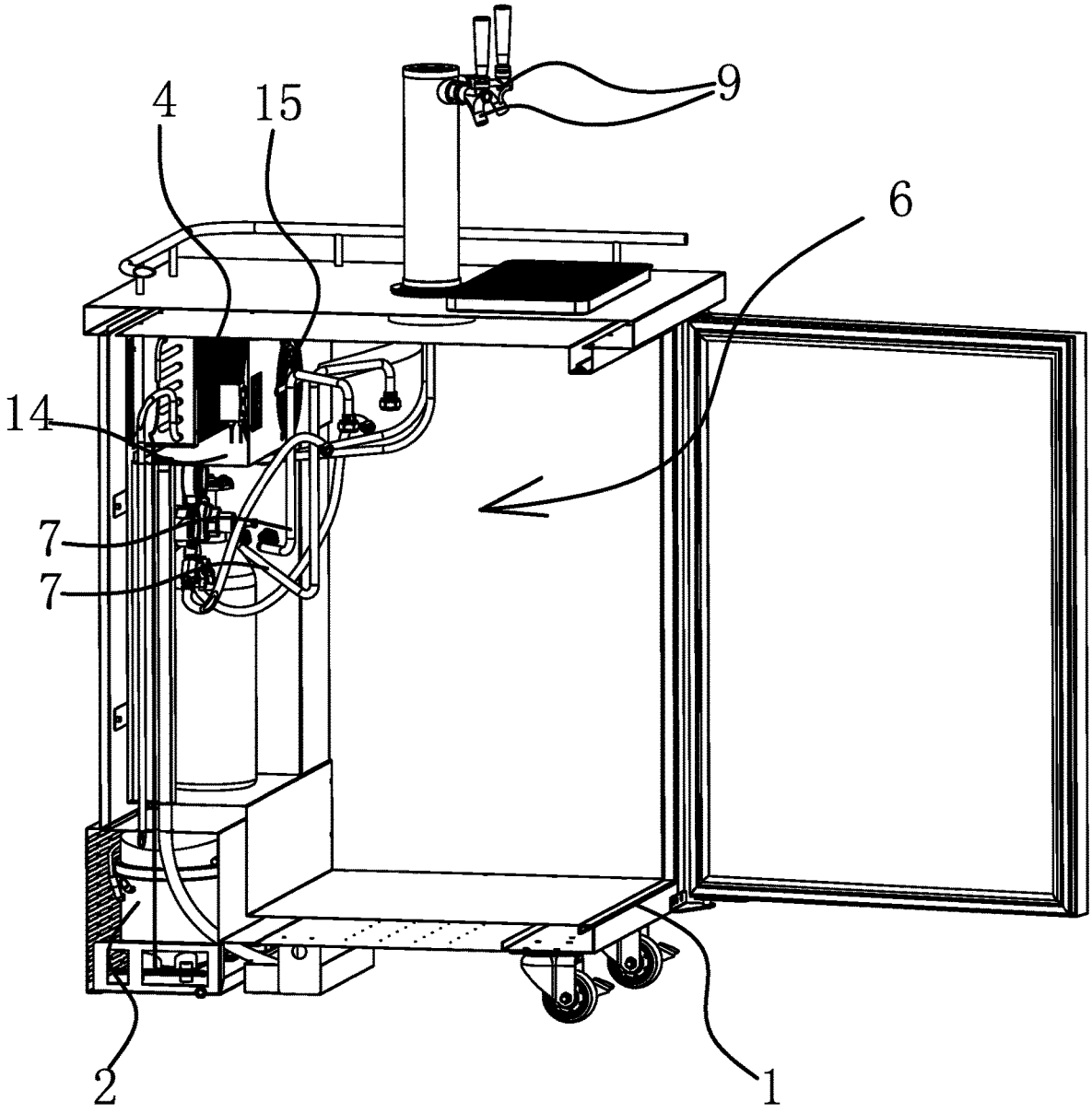
FIG. 1 is a first perspective schematic view of one embodiment of the present invention.
Figure 2:
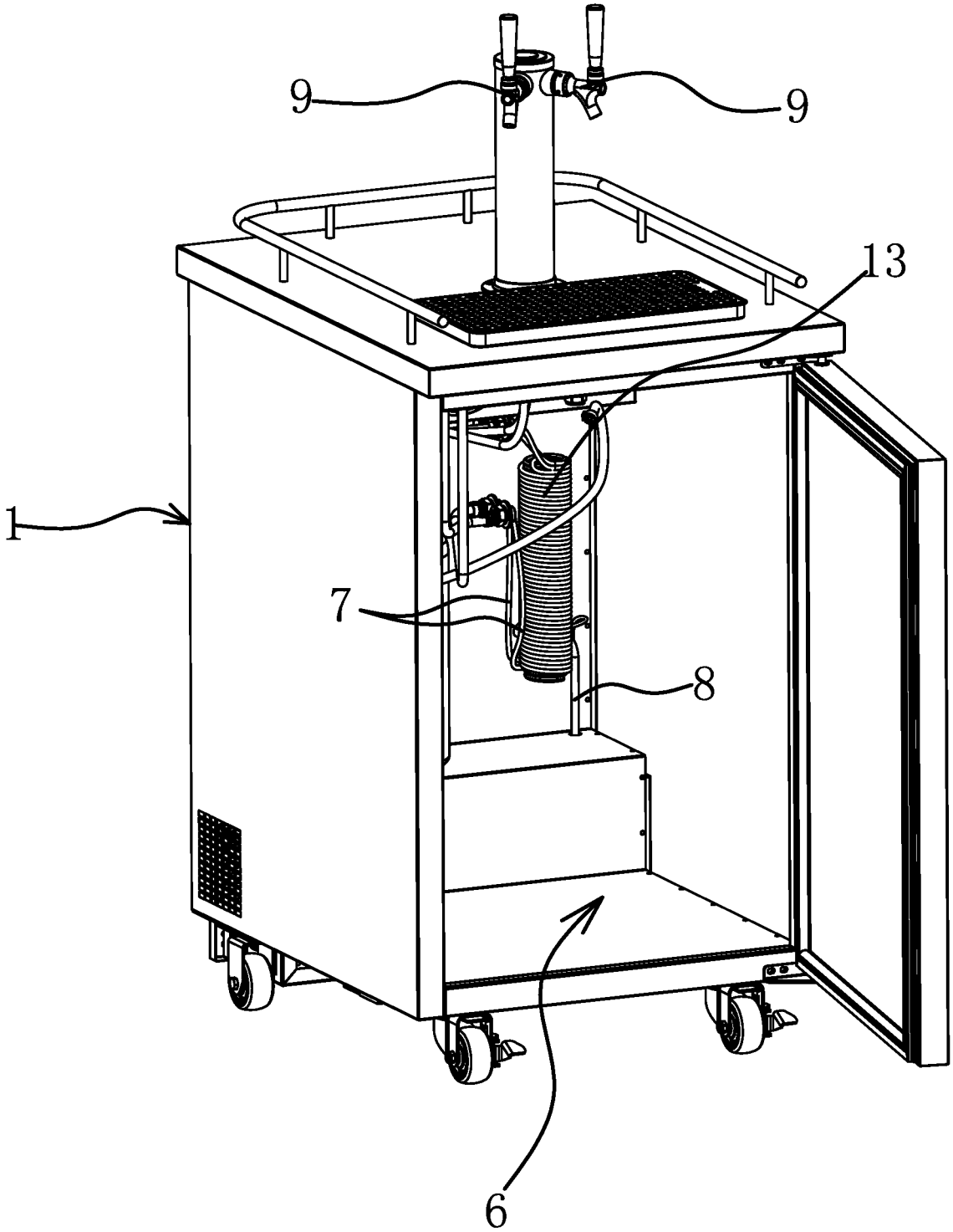
FIG. 2 is a second perspective schematic view of one embodiment of the present invention.
Figure 3:
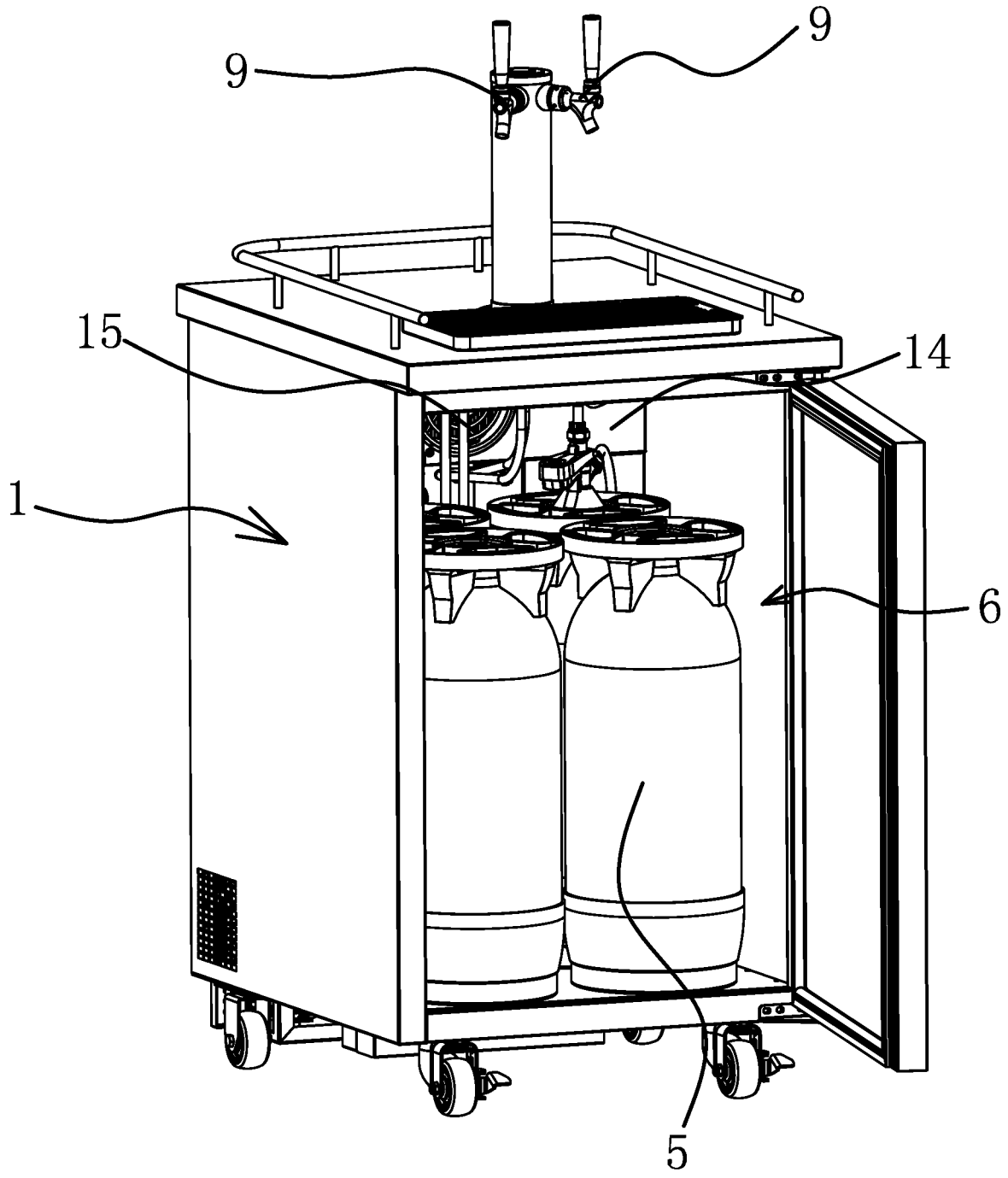
FIG. 3 is a first schematic view of one embodiment of the present invention under the service condition.
Figure 4:
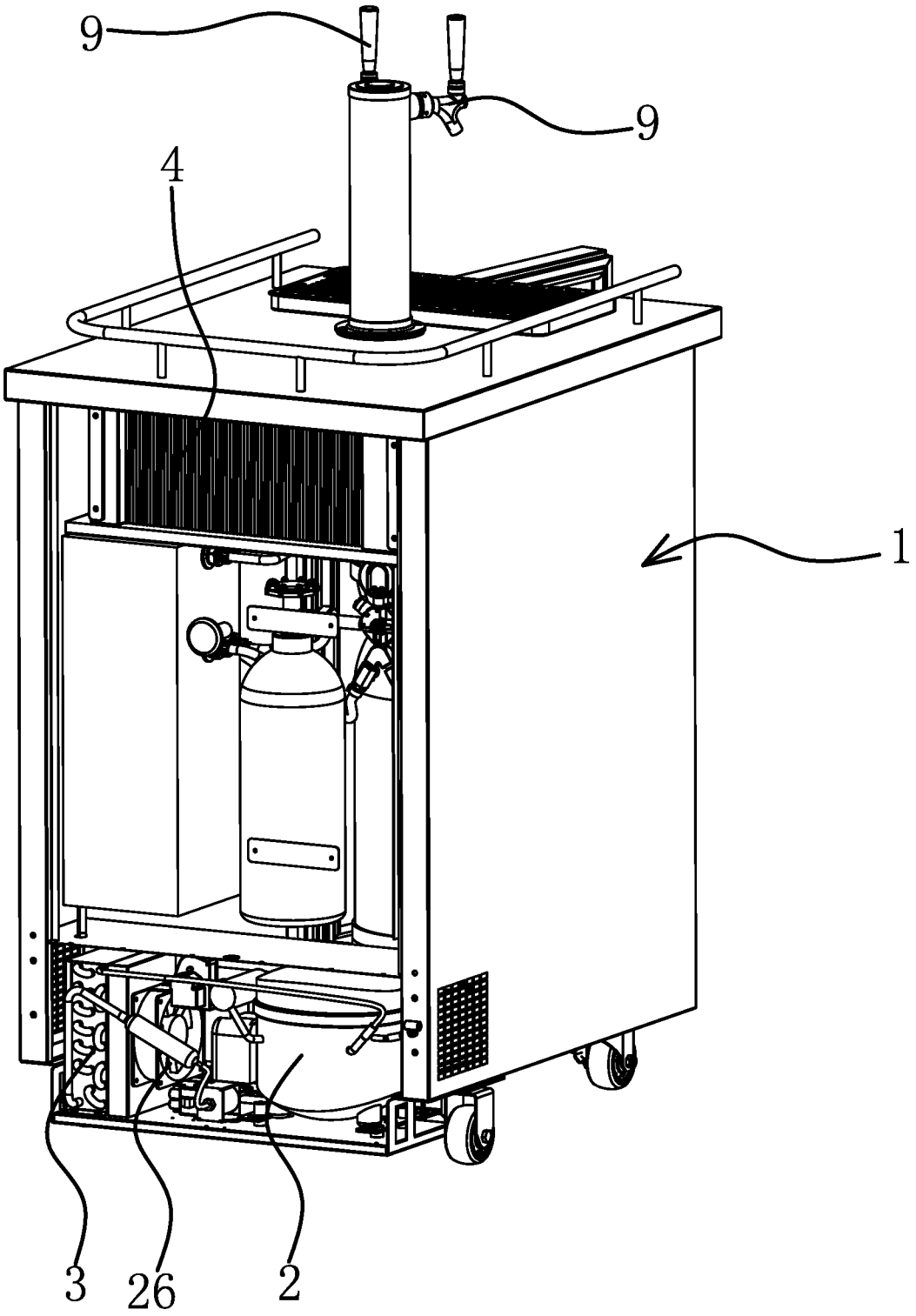
FIG. 4 is a second schematic view of one embodiment of the present invention under the service condition.
Figure 5:
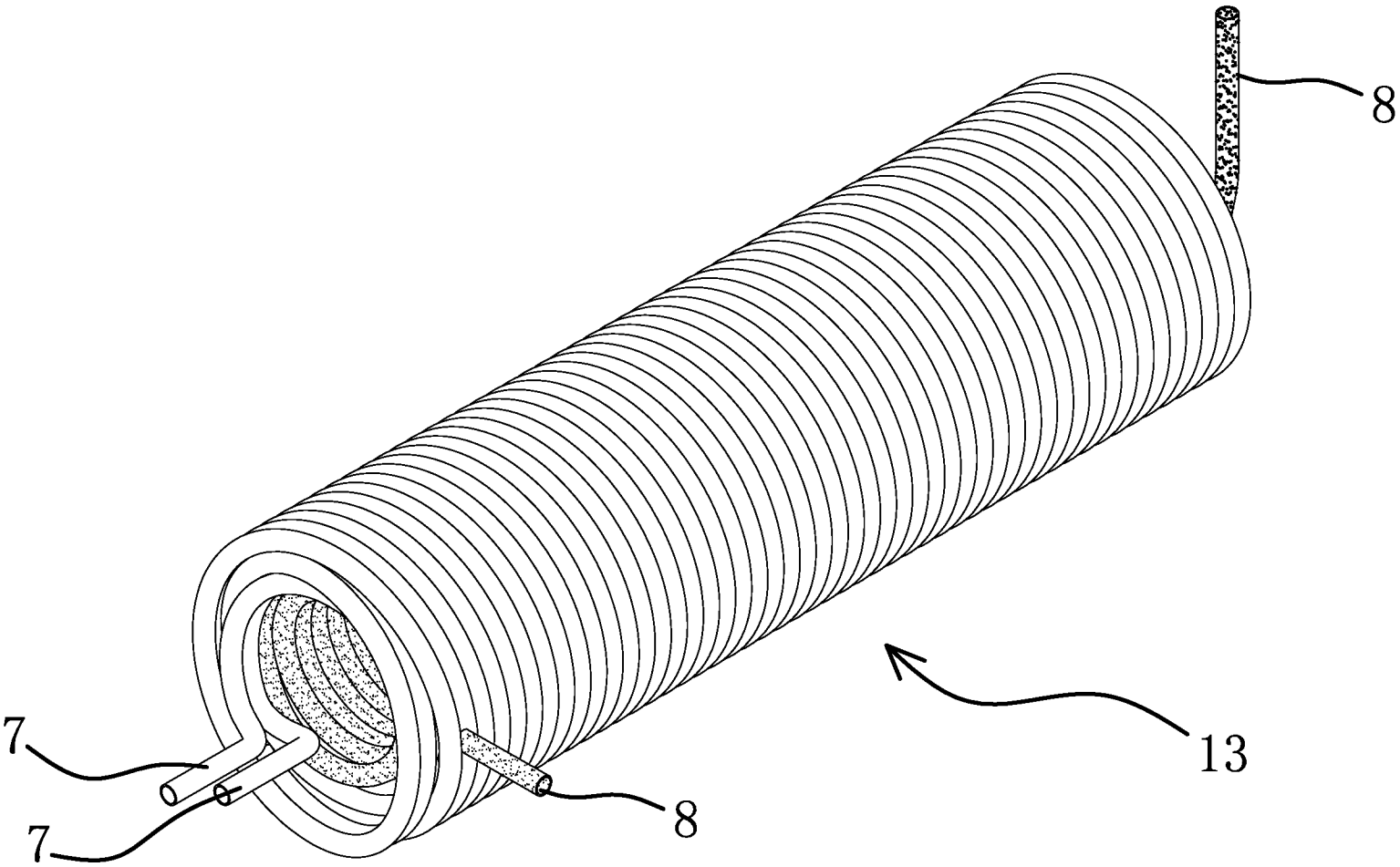
FIG. 5 is a perspective view of one embodiment of the quick cooler in the present invention.

The embodiments of this invention will be described below and the technical solutions of the invention will be further illustrated in connection with the accompanying figures. However, the present invention shall not be limited to these embodiments.

First Embodiment

As shown in FIG. 1 through FIG. 10, a double cooled draft beer machine comprises a cabinet (1), and there is a refrigeration circuit inside the cabinet (1), including a compressor (2), a condenser (3), and an evaporator (4). Inside the cabinet (1), there is a cold storage chamber (6) used to hold the cask (5), and the evaporator (4) can refrigerate the cold storage chamber (6). A beer pipe (7), as well as a refrigeration tube (8) which can refrigerate the beer pipe (7), is also arranged inside the cabinet (1). The refrigeration tube (8) is connected to the refrigeration circuit and is in parallel with the evaporator (4). A beer tap (9) is fixed to the outside of the cabinet (1). The outer end of the beer pipe (7) is connected to the beer tap (9), and its inner end is used to connect to the cask (5).

In the refrigeration circuit, at least one solenoid valve is set up, which is used to open or close the refrigeration circuit for the refrigerant to flow toward the refrigeration tube (8) or the evaporator (4). The present double cooled draft beer machine also comprises a relay (10) used to control the action of the solenoid valve and the first thermostat (11) used to detect the temperature. The detection point (29) of the first thermostat (11) is located between the refrigeration tube (8) and the beer pipe (7). The first thermostat (11) is in series with the relay (10), and the contact of the relay (10) is connected to the solenoid of the solenoid valve, as well as the compressor (2).

When the temperature detected by the first thermostat (11) is higher than the first upper limit temperature threshold set by the first thermostat (11), the relay (10) controls the solenoid valve to allow the refrigerant in the refrigeration circuit to stop flowing toward the evaporator (4), instead, to flow toward the refrigeration tube (8) only. When the temperature detected by the first thermostat (11) is equal to or lower than the first lower limit temperature threshold set by the first thermostat (11), the relay (10) controls the solenoid valve to allow the refrigerant in the refrigeration circuit to stop flowing toward the refrigeration tube (8). The solenoid valve is a 3-way solenoid valve (16). The inlet of the 3-way solenoid valve (16) is connected to the refrigerant outlet of the condenser (3), one outlet of the 3-way solenoid valve (16) is connected to the refrigeration tube (8), and the other outlet is connected to the evaporator (4). As an alternative, there are two solenoid valves: the first solenoid valve (17) and the second solenoid valve (18). The inlet of the first solenoid valve (17) is connected to the refrigerant outlet of the condenser (3), and the outlet is connected to the refrigeration tube (8). The inlet of the second solenoid valve (18) is connected to the refrigerant outlet of the condenser (3), and the outlet is connected to the evaporator (4). The relay (10) has both a normally open contact and a normally closed contact. The normally open contact is connected to the first solenoid valve (17) and the normally closed contact is connected to the second solenoid valve (18).

The second thermostat (12) which can detect the inner temperature of the cold storage chamber (6) is arranged inside the cold storage chamber (6). The second thermostat (12) is in parallel with a series branch consisting of the first thermostat (11) and the relay (10). When the temperature detected by the first thermostat (11) is equal to or lower than the first lower limit temperature threshold, and the inner temperature of the cold storage chamber (6) is higher than the second upper limit temperature threshold set by the second thermostat (12), the relay (10) controls the solenoid valve to allow the refrigerant in the refrigeration circuit to flow toward the evaporator (4). When the temperature detected by the first thermostat (11) is equal to or lower than the first lower limit temperature threshold, and the inner temperature of the cold storage chamber (6) is equal to or lower than the second lower limit temperature threshold set by the second thermostat (12), the second thermostat (12) switches off and makes the compressor (2) stop working.

The current input of the electromagnetic coil of the relay (10) and the contact of the relay (10) are connected to one end of the first thermostat (11), and the other end of the first thermostat (11) is connected to a power supply (22). The current output of the electromagnetic coil of the relay (10) is connected to the power supply (22) to form a circuit. The other contact of the relay (10) is connected to the current input of the solenoid valve and the current input of the compressor (2) respectively. The current output of the solenoid valve and the current output of the compressor (2) are connected to the power supply (22). One end of the second thermostat (12) is connected to the power supply (22), and the other end is connected to the current input of the compressor (2).

The refrigeration tube (8) and the beer pipe (7) are wound into a quick cooler (13) of a round or an elliptic cylindrical shape, in a helical manner. The quick cooler (13) comprises at least one mixing layer, which is formed by winding the refrigeration tube (8) and the beer pipe (7) into a round or elliptic cylindrical shape, in an abreast and helical manner. The inflowing direction of the beer pipe (7) is opposite the flowing direction of the refrigerant in the refrigeration tube (8). The first thermostat (11) is arranged on the quick cooler (13) and the detection point (29) of the first thermostat (11) is close to the outlet end of the beer pipe (7).

A mounting cover (14) is also arranged on the top of the cold storage chamber (6). The mounting cover (14) is fixed to the inner wall of the cabinet (1), and the evaporator (4) is arranged inside mounting cover (14). On the mounting cover (14), there is also an evaporator blower (15) which can blow the cold air diffused from the evaporator (4) into the cold storage chamber (6). The evaporator blower (15) is also connected to the power supply (22). The present double cooled draft beer machine also comprises a condenser blower (26) used to blow the condenser (3) and dissipate the heat. The current input of the condenser blower (26) is connected to the other end of the second thermostat (12), and the current output of the condenser blower (26) is connected to the power supply (22) to form a circuit. A thermal protector (27), which can prevent the compressor (2) from overheating, is also connected between the current input of the compressor (2) and the second thermostat (12).

The following is the working process of the present invention:

The present double cooled draft beer machine comprises a refrigeration circuit including the compressor (2), the condenser (3) and the evaporator (4), and the refrigeration tube (8) is connected to the refrigeration circuit and in parallel with the evaporator (4). This affords two refrigeration modes, firstly, the evaporator (4) can refrigerate the casks (5) in the cold storage chamber (6), and secondly, the refrigeration tube (8) can refrigerate the beer pipe (7). Since the refrigeration tube (8) and the beer pipe (7) are wound into a quick cooler (13) of a round or elliptic cylindrical shape in a helical manner, with the arrangement of the quick cooler (13), the beer pipe (7) and the refrigeration tube (8) adhere tightly and then the cooling capacity is transferred between the refrigeration tube (8) and the beer pipe (7) in the form of dry contact cooling. Also, compared to water cooling, dry contact cooling has an advantage of high speed of cooling capacity transfer, and can further expedite the refrigeration process to achieve a quick cooling effect, so as to fulfill the purpose of quick cooling of beer. The quick cooler (13) may be round or elliptic cylindrical. Both shapes can present smooth bends on the refrigeration tubes (8) and the beer pipes (7). This ensures that the fluid in the beer pipes (7) and the refrigeration tubes (8) flows fluently, can further ensure a uniform distribution of cooling capacity to improve the refrigeration speed, and prevents the tubes from being clogged by ice due to non-uniform local cooling capacity. The arranged location of the first thermostat (11) makes the detection result more accurate. The flowing direction of the fluid in the beer pipe (7) is opposite that of the fluid in the refrigeration tube (8). The refrigerant at a relatively low temperature in the refrigeration tube (8) first transfers the cooling capacity to beer at a higher temperature in the beer pipe (7). Such an arrangement ensures a long refrigeration time of the beer and improves the refrigeration efficiency. Also, after the evaporator (4) fulfills the refrigeration, the refrigeration area and speed are increased by the evaporator blower (15), and the cold storage chamber (6) is refrigerated quickly, so as to refrigerate the casks (5). Therefore, the present double cooled draft beer machine can improve the refrigeration effect of the draft beer machine.

After the present double cooled draft beer machine is powered on, it always refrigerates the refrigeration tube (8) first, so as to ensure beer can always flow out at a relatively low temperature. The temperature detected by the first thermostat (11) may be the temperature of the beer pipe (7) or the temperature of the refrigeration tube (8). When a temperature conductive medium, such as the temperature conductive mud, is arranged between the refrigeration tube (8) and the beer pipe (7), the temperature detected by the first thermostat (11) may also be the temperature of the temperature conductive mud.

The first upper limit temperature threshold and the first lower limit temperature threshold are set on the first thermostat (11). The first upper limit temperature threshold is 5 to 10 degrees Celsius, and the first lower limit temperature threshold is 0 to 6 degrees Celsius. Preferably, the first upper limit temperature threshold is 6 degrees Celsius, and the first lower limit temperature threshold is 1 degrees Celsius.

Figure 6:
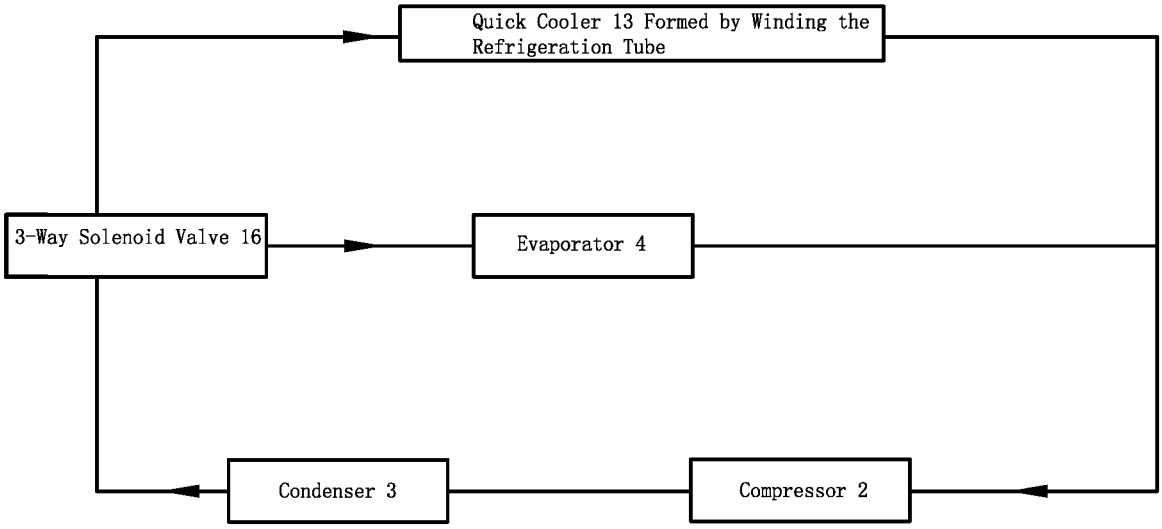
FIG. 6 is a first schematic diagram of the flowing direction of the refrigerant in one embodiment of the present invention.
Figure 9:
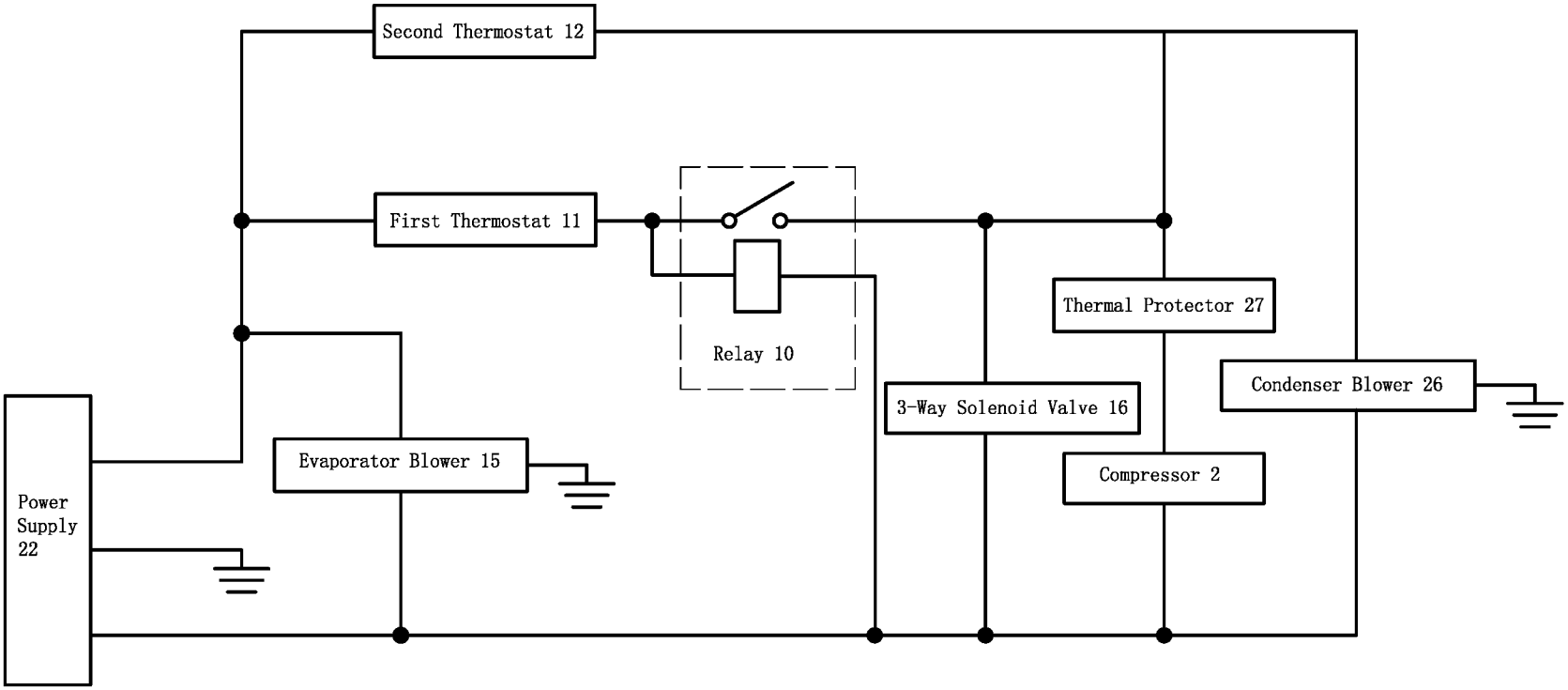
FIG. 9 is a first electric circuit connection diagram of a first embodiment of the present invention.

As shown in FIG. 6 and FIG. 9, after the draft beer machine is powered on, the detection point (29) of the first thermostat (11) senses the detection temperature. When the detection temperature is above 6 degrees Celsius, it means the temperature of the beer passing through the beer pipe (7) is relatively high, and the flavor will be affected. At this point, the switch of the first thermostat (11) is closed to close the circuit between the power supply (22) and the relay (10). The contact of the relay (10) is then closed to power on the 3-way solenoid valve (16). After the 3-way solenoid valve (16) is powered on and acts, the inlet is connected to the outlet which is connected to the refrigeration tube (8), and the compressor (2) is also powered on. At this point, the flowing direction of the refrigerant is switched so that the refrigerant in the refrigeration circuit stops flowing toward the evaporator (4), instead, flows toward the refrigeration tube (8) only. When the refrigerant flows toward the refrigeration tube (8), the temperature of the refrigeration tube (8) decreases, the beer pipe (7) is refrigerated, the temperature of the inflowing beer decreases quickly, and the flavor of beer is improved. The first thermostat (11) detects the temperature continuously. When the detection temperature is equal to or lower than 1 degree Celsius, the switch of the first thermostat (11) is off to power off the relay (10). The contact of the relay (10) is opened, and the 3-way solenoid valve (16) is powered off. Its inlet is connected to the outlet which is connected to the evaporator (4). Only when the first thermostat (11) is opened, does the action of the second thermostat (12) take effect. The second upper limit temperature threshold and the second lower limit temperature threshold are set on the second thermostat (12). The second upper limit temperature threshold is 5 to 10 degrees Celsius, and the second lower limit temperature threshold is 0 to 6 degrees Celsius. Preferably, the second upper limit temperature threshold is 6 degrees Celsius, and the second lower limit temperature threshold is 1 degrees Celsius. When the temperature detected by the first thermostat (11) is equal to or lower than 1 degree Celsius and the temperature inside the cold storage chamber (6) is higher than 6 degrees Celsius, the refrigerant in the refrigeration circuit flows toward the evaporator (4). The evaporator (4) starts refrigeration, and the evaporator blower (15) increases the refrigeration speed of the evaporator (4). When the temperature detected by the first thermostat (11) is equal to or lower than 1 degree Celsius, and the temperature inside the cold storage chamber (6) is lower than or equal to 1 degree Celsius, the switch of the second thermostat (12) is off. At this point, the compressor (2) is disconnected from the power supply (22) and stops working. When the compressor (2) is working, the condenser blower (26) is also powered on, and it dissipates the heat of the condenser (3).

The analysis of the temperature detected by the first thermostat (11) always takes precedence in the present double cooled draft beer machine, no matter when the refrigerant is flowing toward the evaporator (4), or when the compressor (2) is powered off.

Figure 7:
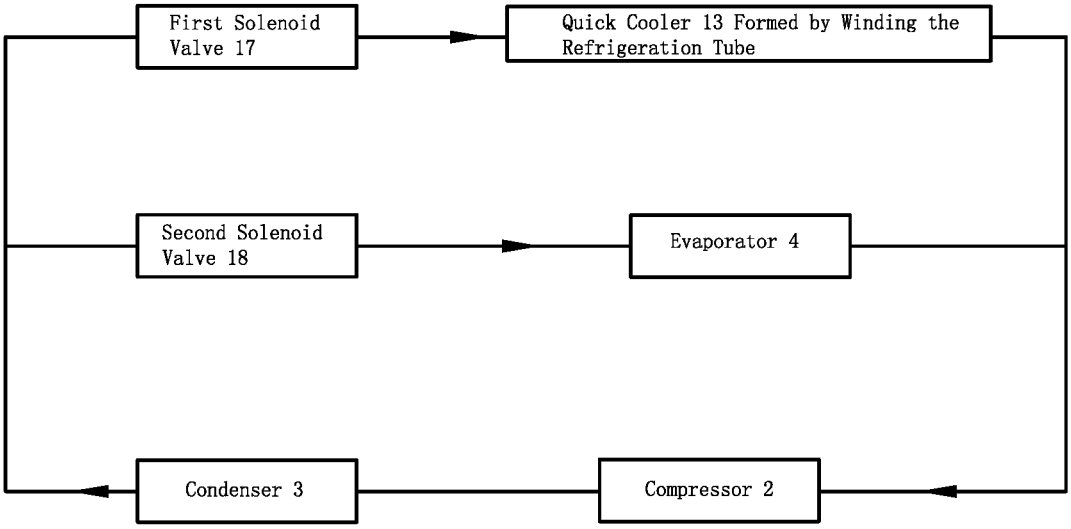
FIG. 7 is a second schematic diagram of the flowing direction of the refrigerant in one embodiment of the present invention.
Figure 8:
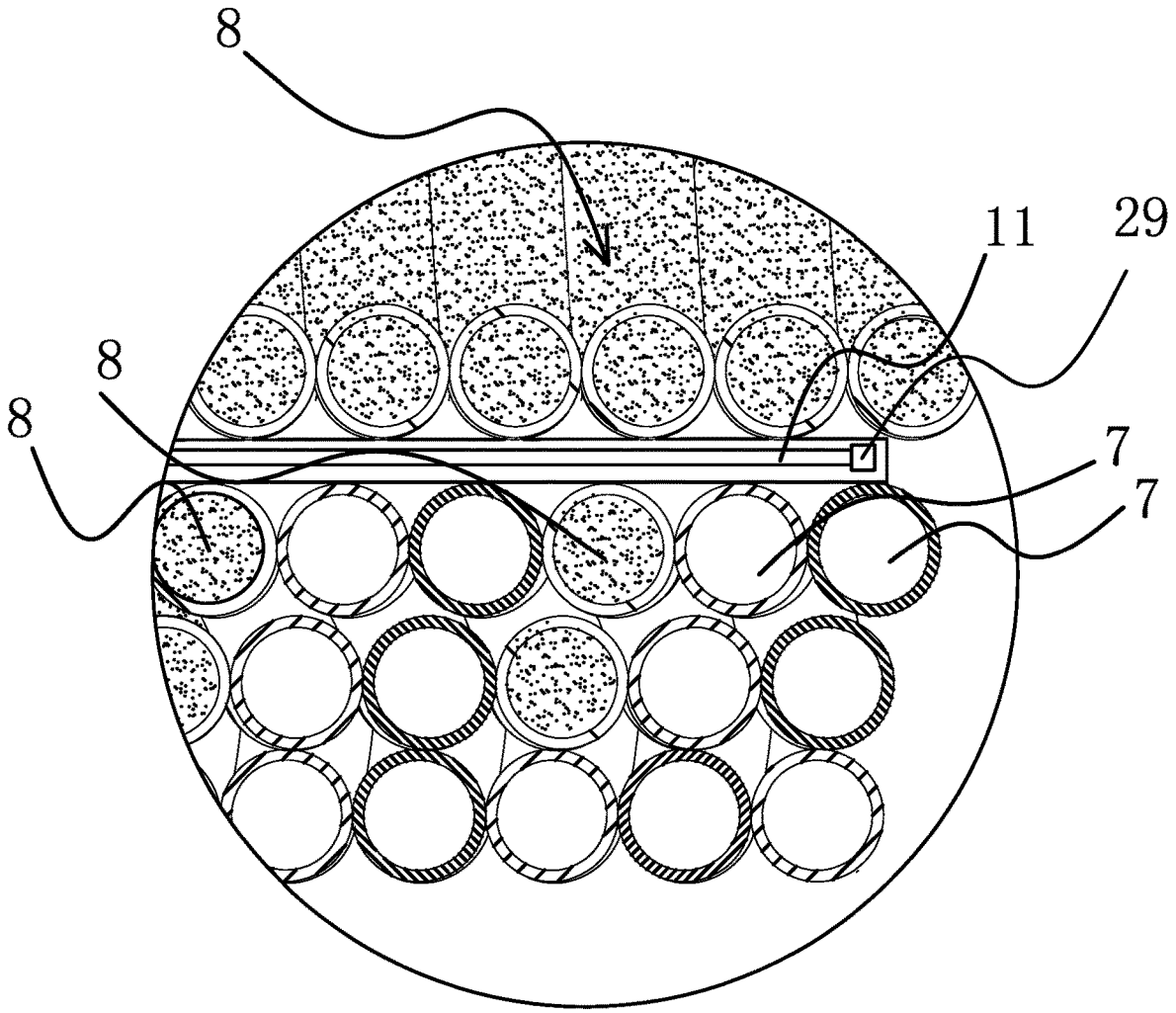
FIG. 8 is a sectional view of an arranged location of the detection point of a first thermostat in the first embodiment of the present invention.
Figure 10:
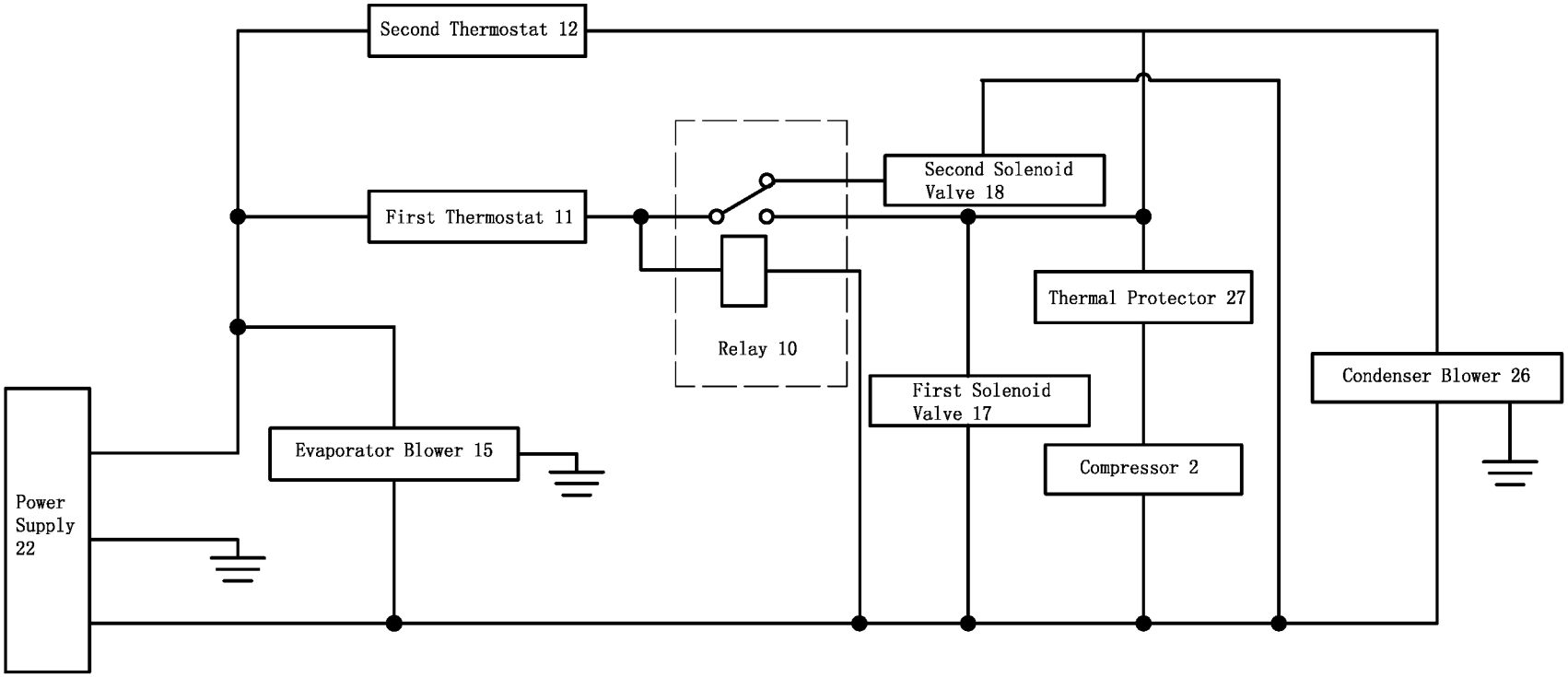
FIG. 10 is a second electric circuit connection diagram of a first embodiment of the present invention.

As an alternative, as shown in FIG. 7 and FIG. 10, there are two solenoid valves: the first solenoid valve (17) and the second solenoid valve (18). The relay (10) has both a normally open contact and a normally closed contact. The normally open contact is connected to the first solenoid valve (17) and the normally closed contact is connected to the second solenoid valve (18). When the relay (10) is powered on, the normally closed contact will be disconnected to switch off the second solenoid valve (18), and the normally open contact is on to switch on the first solenoid valve (17), so the refrigerant flow toward the refrigeration tube (8) only. Other contents are the same as the contents in the description above where the 3-way solenoid valve (16) is adopted.

Second Embodiment

Figure 11:
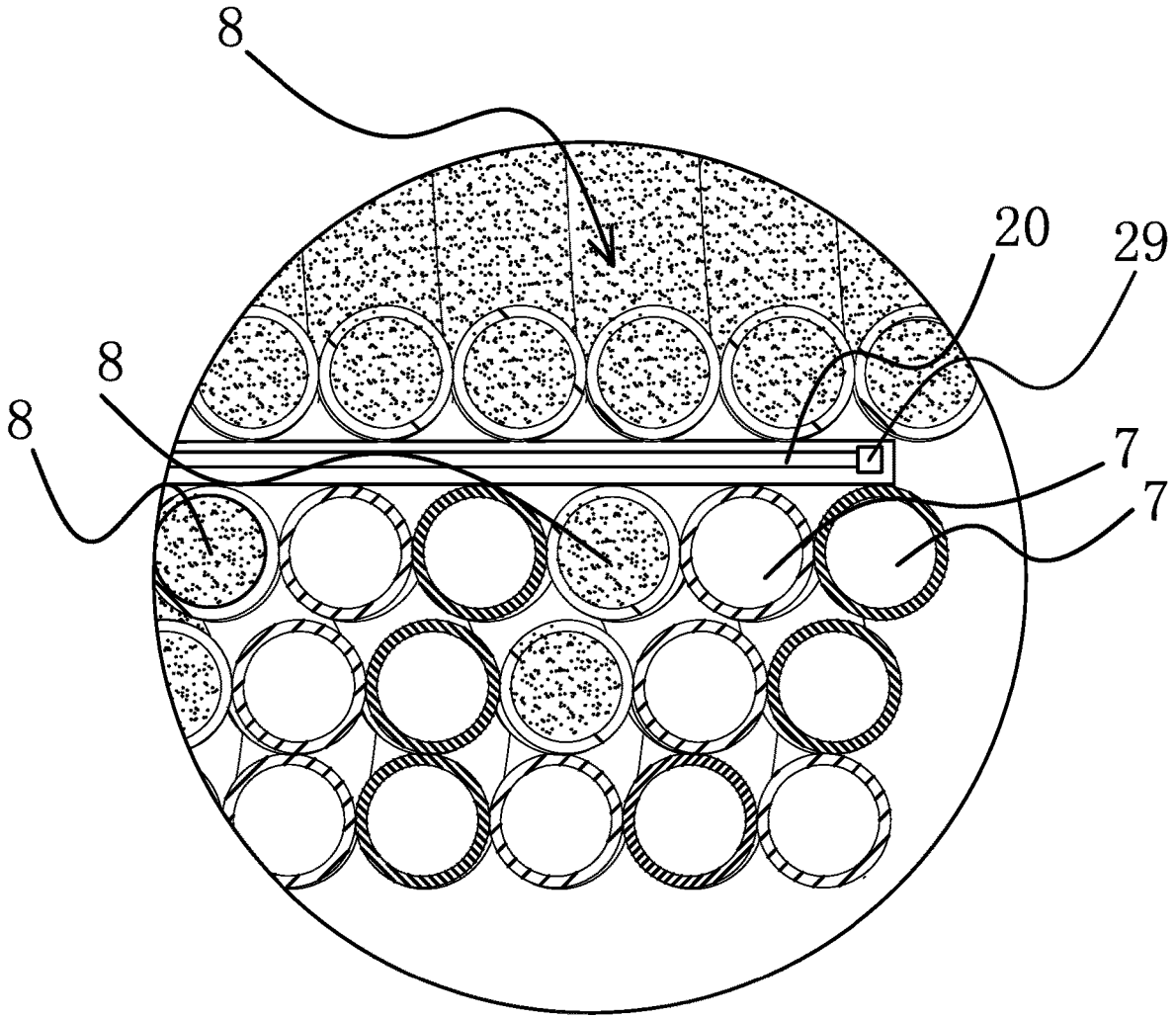
FIG. 11 is a sectional view of an arranged location of the detection point of a first temperature sensor in the second embodiment of the present invention.
Figure 12:
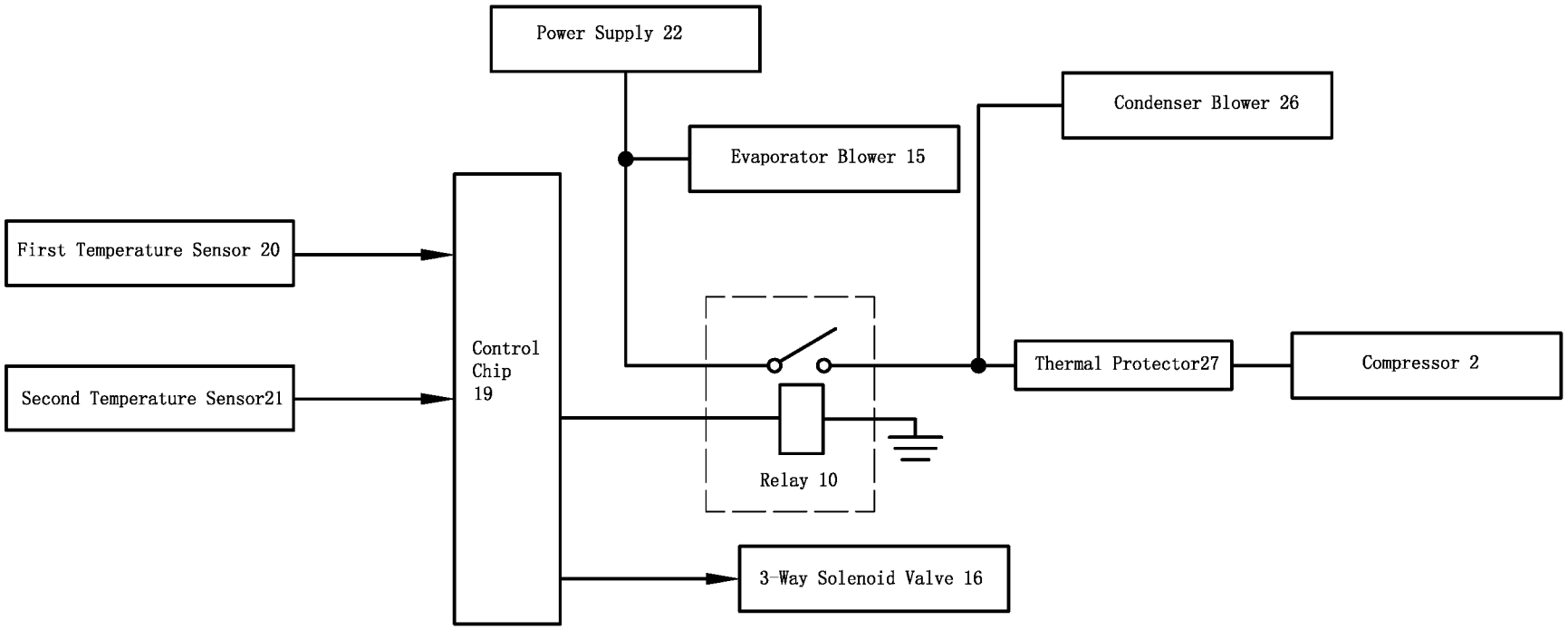
FIG. 12 is a first electric circuit connection diagram of a second embodiment of the present invention.
Figure 13:
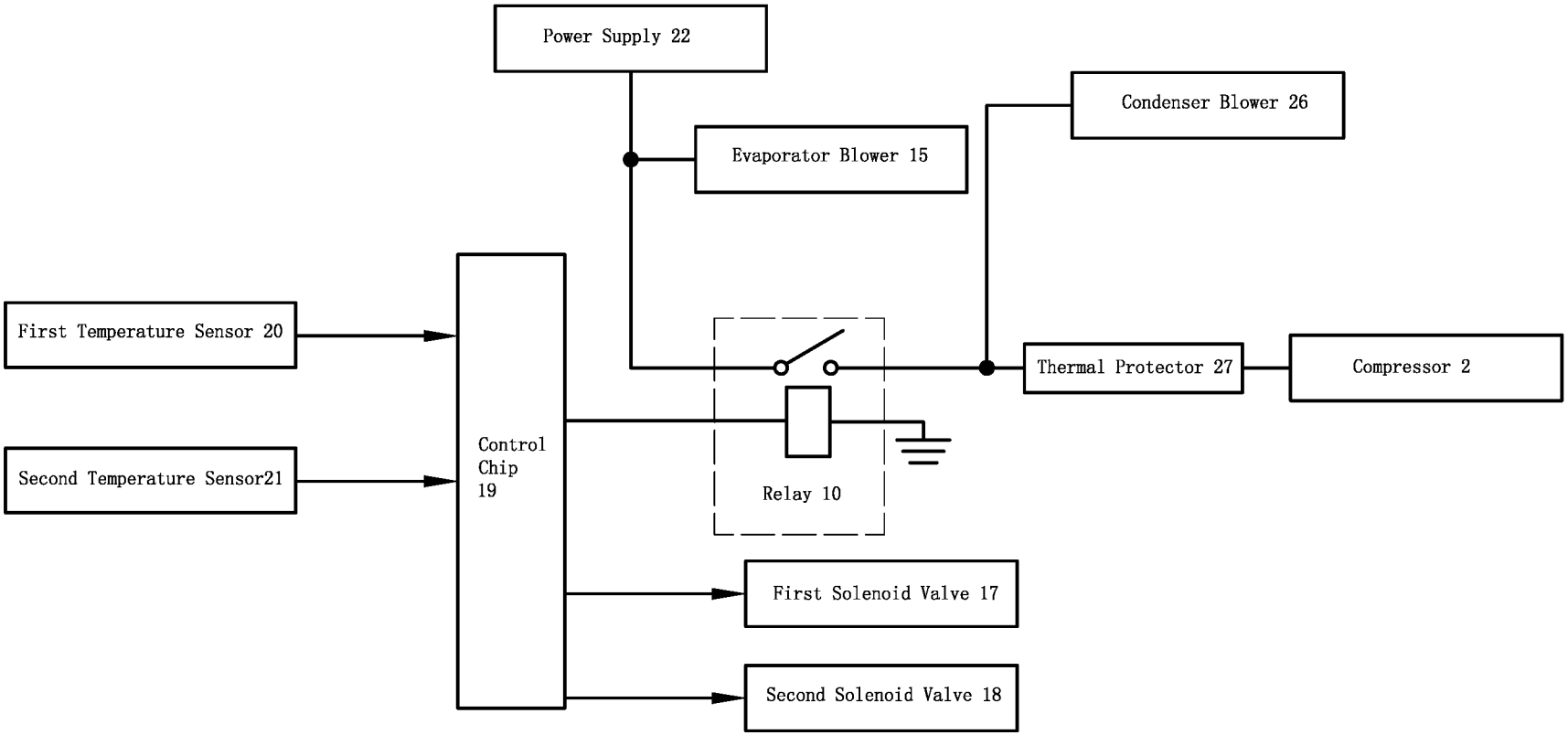
FIG. 13 is a second electric circuit connection diagram of a second embodiment of the present invention.

As shown in FIG. 1 through FIG. 7, as well as in FIG. 11 through FIG. 13, the structure and the working process of the second embodiment are basically the same as those in the first embodiment. The differences are:

The present double cooled draft beer machine comprises a control chip (19) used to control the action of the solenoid valve and the first temperature sensor (20) used to detect the temperature. The detection point (29) of the first temperature sensor (20) is located between the refrigeration tube (8) and the beer pipe (7). The first temperature sensor (20) is connected to the input end of the control chip (19), the solenoid valve is connected to the output end of the control chip (19), and a relay (10) used to control the on-off operation of the compressor (2) is also connected to the output end of the control chip (19). The electromagnetic coil of the relay (10) is connected to output end of the control chip (19), and the normally open contact of the relay (10) is connected to between the compressor (2) and the power supply (22) of the compressor (2). The first upper limit temperature threshold and the first lower limit temperature threshold of the beer pipe (7) are set inside the control chip (19). When the temperature detected by the first temperature sensor (20) is higher than the first upper limit temperature threshold, the control chip (19) controls the solenoid valve to act and switch on the compressor (2) to allow the refrigerant to stop flowing toward the evaporator (4), instead, to flow toward the refrigeration tube (8) only. When the temperature detected by the first temperature sensor (20) is equal to or lower than the first lower limit temperature threshold, the control chip (19) controls the solenoid valve to act to allow the refrigerant in the refrigeration circuit to stop flowing toward the refrigeration tube (8). The first temperature sensor (20) is arranged on the quick cooler (13) and the detection point (29) of the first temperature sensor (20) is close to the outlet end of the beer pipe (7).

The present double cooled draft beer machine also comprises the second temperature sensor (21) to detect the inner temperature of the cold storage chamber (6). The second temperature sensor (21) is connected to the input end of the control chip (19), and the second upper limit temperature threshold and the second lower limit temperature threshold of the cold storage chamber (6) are set inside the control chip (19). When the temperature detected by the first temperature sensor (20) is equal to or lower than the first lower limit temperature threshold, and the inner temperature of the cold storage chamber (6) is higher than the second upper limit temperature threshold, the control chip (19) controls the solenoid valve to act and switches on the compressor (2) to allow the refrigerant to flow toward the evaporator (4). When the temperature detected by the first temperature sensor (20) is equal to or lower than the first lower limit temperature threshold, and the inner temperature of the cold storage chamber (6) is equal to or lower than the second lower limit temperature threshold, the control chip (19) controls the relay (10) to switch off the compressor (2) and make it stop working.

The following is the working process of this embodiment:

The present double cooled draft beer machine comprises a refrigeration circuit including the compressor (2), the condenser (3) and the evaporator (4), and the refrigeration tube (8) is connected to the refrigeration circuit and in parallel with the evaporator (4). This affords two refrigeration modes, firstly, the evaporator (4) can refrigerate the casks (5) in the cold storage chamber (6), and secondly, the refrigeration tube (8) can refrigerate the beer pipe (7). After the present double cooled draft beer machine is powered on, it always refrigerates the refrigeration tube (8) first, so as to ensure beer can always flow out at a relatively low temperature. The first upper limit temperature threshold and the first lower limit temperature threshold of the beer pipe (7) are set in the control chip (19). The first upper limit temperature threshold is 5 to 10 degrees Celsius, and the first lower limit temperature threshold is 0 to 6 degrees Celsius. Preferably, the first upper limit temperature threshold is 6 degrees Celsius, and the first lower limit temperature threshold is 1 degrees Celsius. The second upper limit temperature threshold is 5 to 10 degrees Celsius, and the second lower limit temperature threshold is 0 to 6 degrees Celsius. Preferably, the second upper limit temperature threshold is 6 degrees Celsius, and the second lower limit temperature threshold is 1 degrees Celsius. The temperature detected by the first temperature sensor (20) may be the temperature of the beer pipe (7) or the temperature of the refrigeration tube (8). When a temperature conductive medium, such as the temperature conductive mud, is arranged between the refrigeration tube (8) and the beer pipe (7), the temperature detected by the first temperature sensor (20) may also be the temperature of the temperature conductive mud.

After the draft beer machine is powered on, when the temperature detected by the first temperature sensor (20) is higher than 6 degrees Celsius set by the control chip (19), it is indicated that the temperature of beer passing through the beer pipe (7) is relatively high, and the flavor will be affected. At this point, the control chip (19) sends electronic signals to the relay (10), and the normally open contact of the relay (10) is closed to close the circuit between the compressor (2) and the power supply (22). Meanwhile, the control chip (19) sends electronic signals to the 3-way solenoid valve (16). The 3-way solenoid valve (16) acts after it is powered on, connecting the inlet to the outlet which is connected to the refrigeration tube (8), and the compressor (2) is also powered on. At this point, the flowing direction of the refrigerant is switched so that the refrigerant in the refrigeration circuit stops flowing toward the evaporator (4), instead, flows toward the refrigeration tube (8) only. When the refrigerant flows toward the refrigeration tube (8), the temperature of the refrigeration tube (8) decreases, the beer pipe (7) is hence refrigerated, and the temperature of the inflowing beer decreases. When the temperature detected by the first temperature sensor (20) is equal to or lower than 1 degree Celsius, the control chip (19) controls the 3-way solenoid valve (16) to power off, and its inlet is connected to the outlet which is connected to the evaporator (4). The second temperature sensor (21) detects the temperature of the cold storage chamber (6). When the condition that the temperature of inflowing beer of the beer pipe (7) is equal to or lowers than 1 degrees Celsius and the temperature of the cold storage chamber (6) is higher than 6 degrees Celsius is met, the control chip (19) keeps the compressor (2) working, and the refrigerant flows toward the evaporator (4) at this point. The evaporator (4) starts refrigeration, and the evaporator blower (15) increases the refrigeration speed of the evaporator (4). When the temperature detected by the first temperature sensor (20) is still equal to or lower than 1 degrees Celsius, and the temperature inside the cold storage chamber (6) is lower than or equal to 1 degrees Celsius, the control chip (19) controls the relay (10) to be powered off, and the compressor (2) is disconnected from the power supply (22) and stops working. When the compressor (2) is working, the condenser blower (26) is also powered on, and it dissipates the heat of the condenser (3).

The analysis of the temperature detected by the first temperature sensor (20) always takes precedence in the present double cooled draft beer machine, no matter when the refrigerant is flowing toward the evaporator (4), or when the compressor (2) is powered off.

As an alternative, as shown in FIG. 7 and FIG. 13, there are two solenoid valves: the first solenoid valve (17) and the second solenoid valve (18). The control chip (19) controls the on-off operation of the first solenoid valve (17) and the second solenoid valve (18) respectively. When the first solenoid valve (17) is switched on, the second solenoid valve (18) is switched off. Other contents are the same as the contents in the description above where the 3-way solenoid valve (16) is adopted.

Third Embodiment

Figure 14:
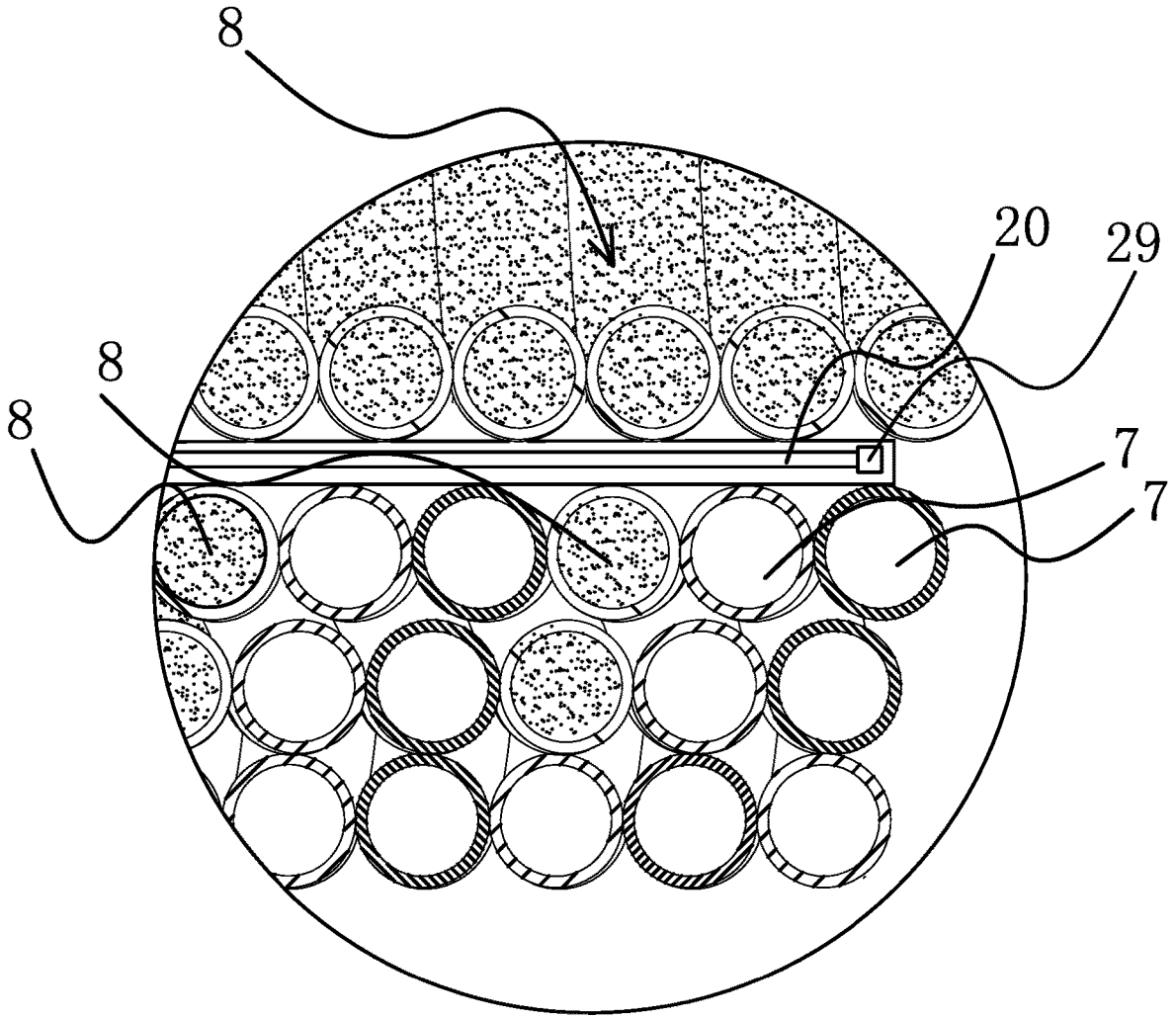
FIG. 14 is a sectional view of an arranged location of the detection point of the first temperature sensor in a third embodiment of the present invention.
Figure 15:
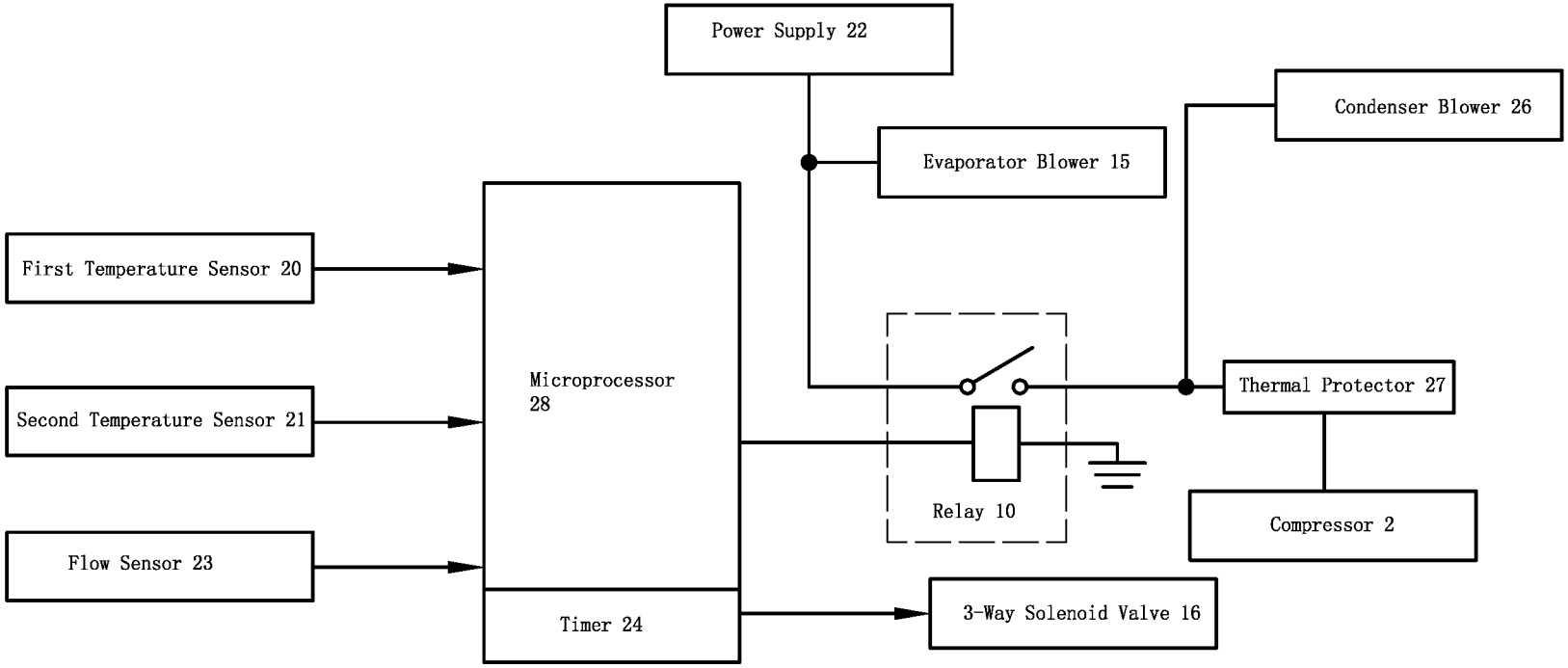
FIG. 15 is a first electric circuit connection diagram of a third embodiment of the present invention.
Figure 16:
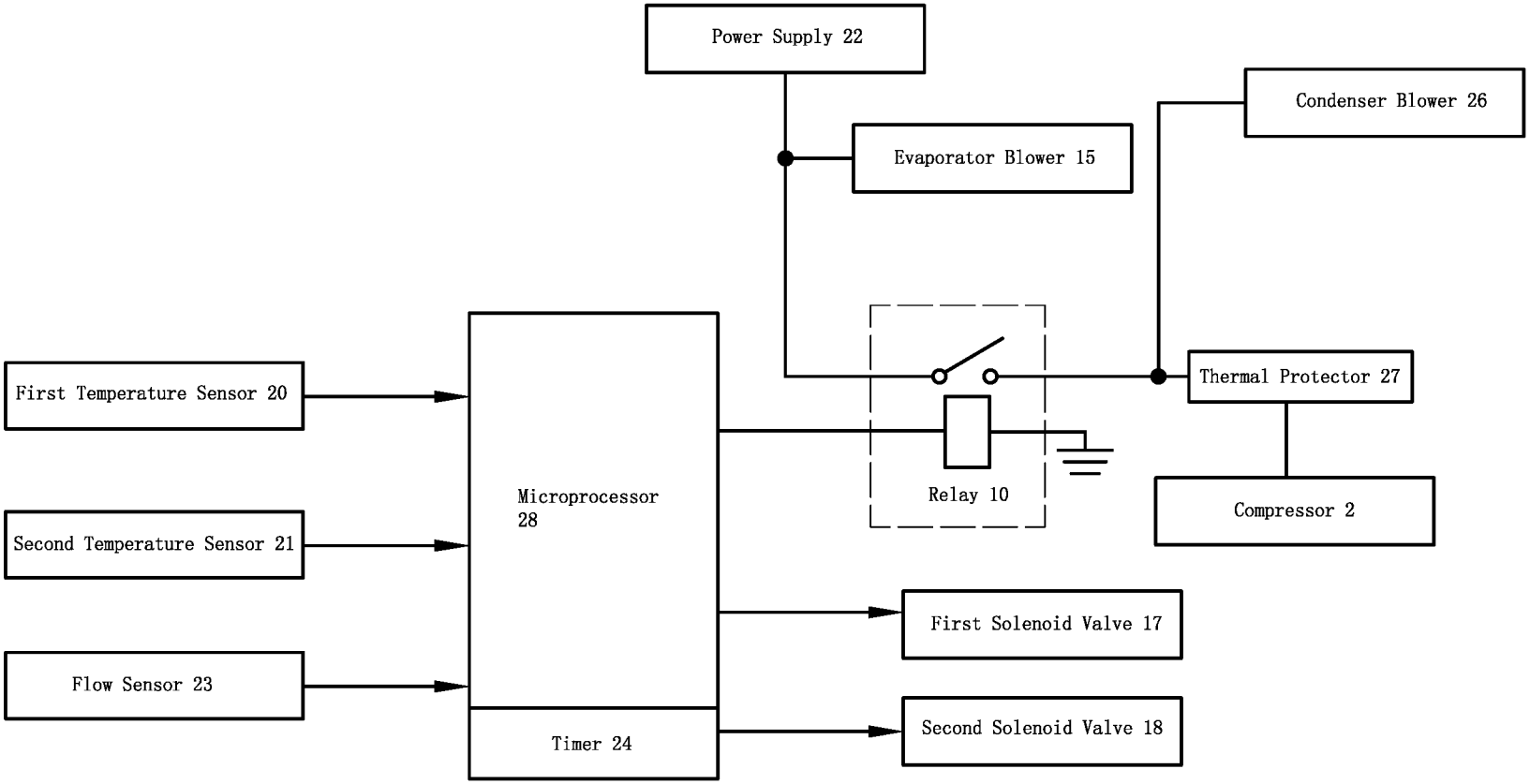
FIG. 16 is a second electric circuit connection diagram of a third embodiment of the present invention.

As shown in FIG. 1 through FIG. 7, as well as in FIG. 14 through FIG. 16, the structure and the working process of the second embodiment are basically the same as those in the first embodiment. The differences in the structure are:

The present double cooled draft beer machine also comprises a microprocessor (28) used to control the action of the solenoid valve, the first temperature sensor (20) used to detect the temperature, a flow sensor (23) used to detect the beer flow of the beer pipe (7), and a relay (10) used to the control the on-off operation of the compressor (2). The first temperature sensor (20) is arranged on the quick cooler (13) and the detection point (29) of the first temperature sensor (20) is close to the outlet end of the beer pipe (7). The electromagnetic coil of the relay (10) is connected to output end of the microprocessor (28), and the normally open contact of the relay (10) is connected to between the compressor (2) and the power supply (22) of the compressor (2). The flow sensor (23) is arranged on the beer pipe (7), next to the beer tap (9). There is a timer (24) inside the microprocessor (28). The flow sensor (23) and the first temperature sensor (20) are connected to the input end of the microprocessor (28) respectively, and the solenoid valve and the relay (10) are connected to the output end of the microprocessor (28) respectively. The first lower limit temperature threshold is set inside the microprocessor (28). When a flow passes through the beer pipe (7), the timer (24) re-starts timing. Within the timing interval set by the microprocessor (28), when the beer flow in the beer pipe (7) reaches the flow threshold set by the microprocessor (28), the microprocessor (28) controls the solenoid valve to act and switches on the compressor (2) to allow the refrigerant to stop flowing toward the evaporator (4), instead, to flow toward the refrigeration tube (8) only. When the temperature detected by the first temperature sensor (20) is equal to or lower than the first lower limit temperature threshold, the microprocessor (28) controls the solenoid valve to act to allow the refrigerant in the refrigeration circuit to stop flowing toward the refrigeration tube (8).

The second temperature sensor (21) which can detect the inner temperature of the cold storage chamber (6) is arranged inside the cold storage chamber (6). The second temperature sensor (21) is connected to the input end of the microprocessor (28), and the second lower limit temperature threshold is set inside the microprocessor (28). When the temperature detected by the first temperature sensor (20) is equal to or lower than the first lower limit temperature threshold, the microprocessor (28) controls the solenoid valve to act and switches on the compressor (2) to allow the refrigerant to flow toward the evaporator (4). When the temperature detected by the first temperature sensor (20) is equal to or lower than the first lower limit temperature threshold, and the inner temperature of the cold storage chamber (6) is equal to or lower than the second lower limit temperature threshold, the microprocessor (28) controls the relay (10) to switch off the compressor (2) and make it stop working. The first temperature sensor (20) is arranged on the quick cooler (13) and the detection point (29) of the first temperature sensor (20) is close to the beer pipe (7).

The following is the working process of this embodiment:

The present double cooled draft beer machine comprises a refrigeration circuit including the compressor (2), the condenser (3) and the evaporator (4), and the refrigeration tube (8) is connected to the refrigeration circuit and in parallel with the evaporator (4). This affords two refrigeration modes, firstly, the evaporator (4) can refrigerate the casks (5) in the cold storage chamber (6), and secondly, the refrigeration tube (8) can refrigerate the beer pipe (7). After the present double cooled draft beer machine is powered on, it always refrigerates the refrigeration tube (8) first, so as to ensure beer can always flow out at a relatively low temperature. The first lower limit temperature threshold and the second lower limit temperature threshold of the beer pipe (7), the flow threshold, and the timing interval are set in the microprocessor (28). The range of the first lower limit temperature threshold is 0 to 6 degrees Celsius, and preferably, the first lower limit temperature threshold is 1 degrees Celsius. The range of the second lower limit temperature threshold is 0 to 6 degrees Celsius, and preferably, the second lower limit temperature threshold is 1 degree Celsius. The flow threshold is 500 to 1500 milliliters, and preferably 500 milliliters. The timing interval is 5 to 20 minutes and preferably 10 minutes.

The temperature detected by the first temperature sensor (20) may be the temperature of the beer pipe (7) or the temperature of the refrigeration tube (8). When a temperature conductive medium, such as the temperature conductive mud, is arranged between the refrigeration tube (8) and the beer pipe (7), the temperature detected by the first temperature sensor (20) may also be the temperature of the temperature conductive mud.

The flow sensor (23) detects the flow inside the beer pipe (7) in real time and sends detection signals to the microprocessor (28). When the microprocessor (28) just receives the signals sent by the flow sensor (23), it is indicated that beer is flowing into the beer pipe (7). At this point, the microprocessor (28) controls the timer (24) to start timing. When the flow of the beer pipe (7) reaches 500 milliliters within 10 minutes, it is indicated that much beer is discharged during a short period. This would take away the cooling capacity in the refrigeration tube (8), makes the temperature of the refrigeration tube (8) increase quickly, and at the meanwhile, the temperature of the beer pipe (7) also increases. At this point, the microprocessor (28) sends electronic signals to the relay (10), and the normally open contact of the relay (10) is closed to close the circuit between the compressor (2) and the power supply (22). Meanwhile, the microprocessor (28) sends electronic signals to the 3-way solenoid valve (16), the 3-way solenoid valve (16) is powered on and acts, connecting the inlet to the outlet which is connected to the refrigeration tube (8), and the compressor (2) is also powered on. At this point, the flowing direction of the refrigerant is switched so that the refrigerant in the refrigeration circuit stops flowing toward the evaporator (4), instead, flows toward the refrigeration tube (8) only. When the refrigerant flows toward the refrigeration tube (8), the temperature of the refrigeration tube (8) decreases, the beer pipe (7) is hence refrigerated, and the temperature of the inflowing beer decreases. When the temperature detected by the first temperature sensor (20) is equal to or lower than 1 degree Celsius, the microprocessor (28) controls the 3-way solenoid valve (16) to power off, and its inlet is connected to the outlet which is connected to the evaporator (4). The second temperature sensor (21) detects the temperature of the cold storage chamber (6). Only after the refrigeration to the refrigeration tube (8) is fulfilled, the cold storage chamber (6) will be refrigerated. Within the given 10 minutes, and when the flow in the beer pipe (7) reaches 500 milliliters, even if the microprocessor (28) is controlling the refrigerant in the refrigeration circuit to flow toward the evaporator (4), the refrigerant will be switched to flowing toward the refrigeration tube (8) to first fulfill the refrigeration to the beer pipe (7), so as to ensure that beer can always flow out at a relatively low temperature. When the refrigeration condition under which the refrigerant flows toward the refrigeration tube (8) is not met, and the temperature inside the cold storage chamber (6) is lower than or equal to 1 degrees Celsius, the control chip (19) controls the relay (10) to be powered off, and the compressor (2) is disconnected from the power supply (22) and stops working. When the compressor (2) is working, the condenser blower (26) is also powered on, and it dissipates the heat of the condenser (3). The refrigeration condition under which the refrigerant flows toward the refrigeration tube (8) is that the flow inside the beer pipe (7) reaches 500 milliliters within the given 10 minutes.

After the microprocessor (28) controls the solenoid valve and the compressor (2) to act according to signals from the flow sensor (23) and electronic signals from the timer (24), the microprocessor (28) clears the flow value sent by the flow sensor (23). Also, after the recorded time of the timer (24) reaches the given timing interval, and when beer flow appears inside the beer pipe (7) again, the microprocessor (28) starts timing.

The analysis of the beer flow of the beer pipe (7) always takes precedence in the present double cooled draft beer machine, no matter when the refrigerant is flowing toward the evaporator (4), or when the compressor (2) is powered off.

As an alternative, as shown in FIG. 7 and FIG. 16, there are two solenoid valves: the first solenoid valve (17) and the second solenoid valve (18). The microprocessor (28) controls the on-off operation of the first solenoid valve (17) and the second solenoid valve (18) respectively. When the first solenoid valve (17) is switched on, the second solenoid valve (18) is switched off. Other contents are the same as the contents in the description above where the 3-way solenoid valve (16) is adopted.

Fourth Embodiment

Figure 17:
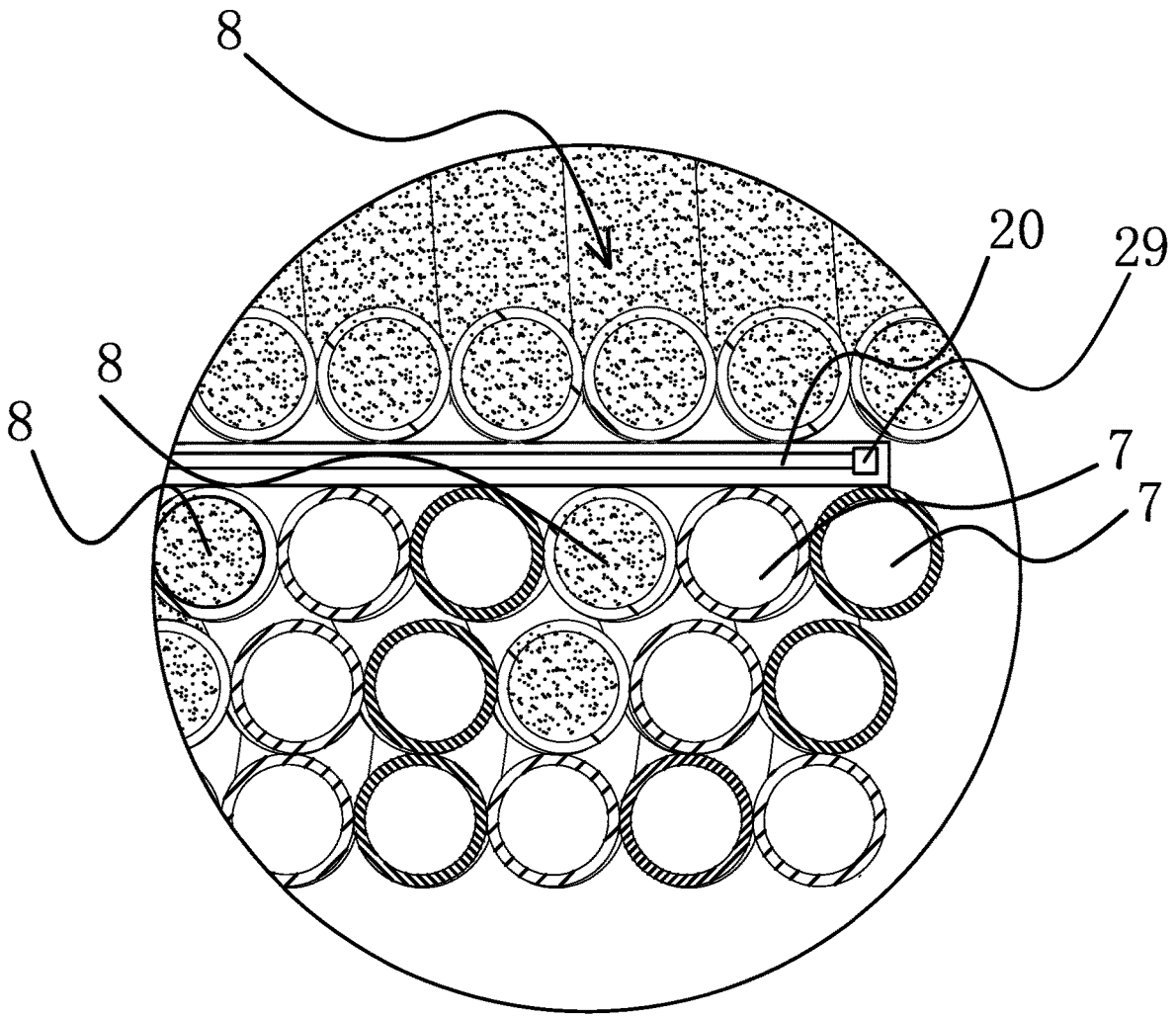
FIG. 17 is a sectional view of an arranged location of the detection point of the first temperature sensor in a fourth embodiment of the present invention.
Figure 18:
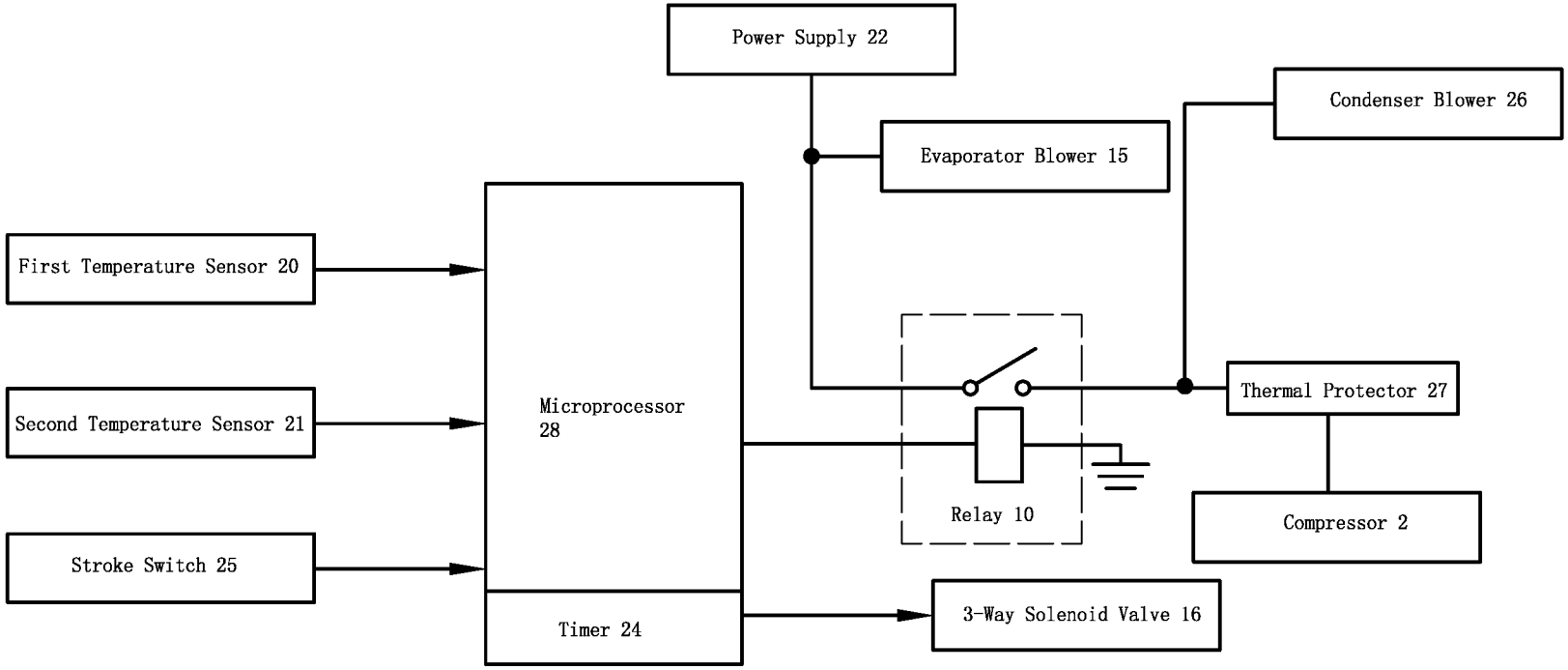
FIG. 18 is a first electric circuit connection diagram of a fourth embodiment of the present invention.
Figure 19:
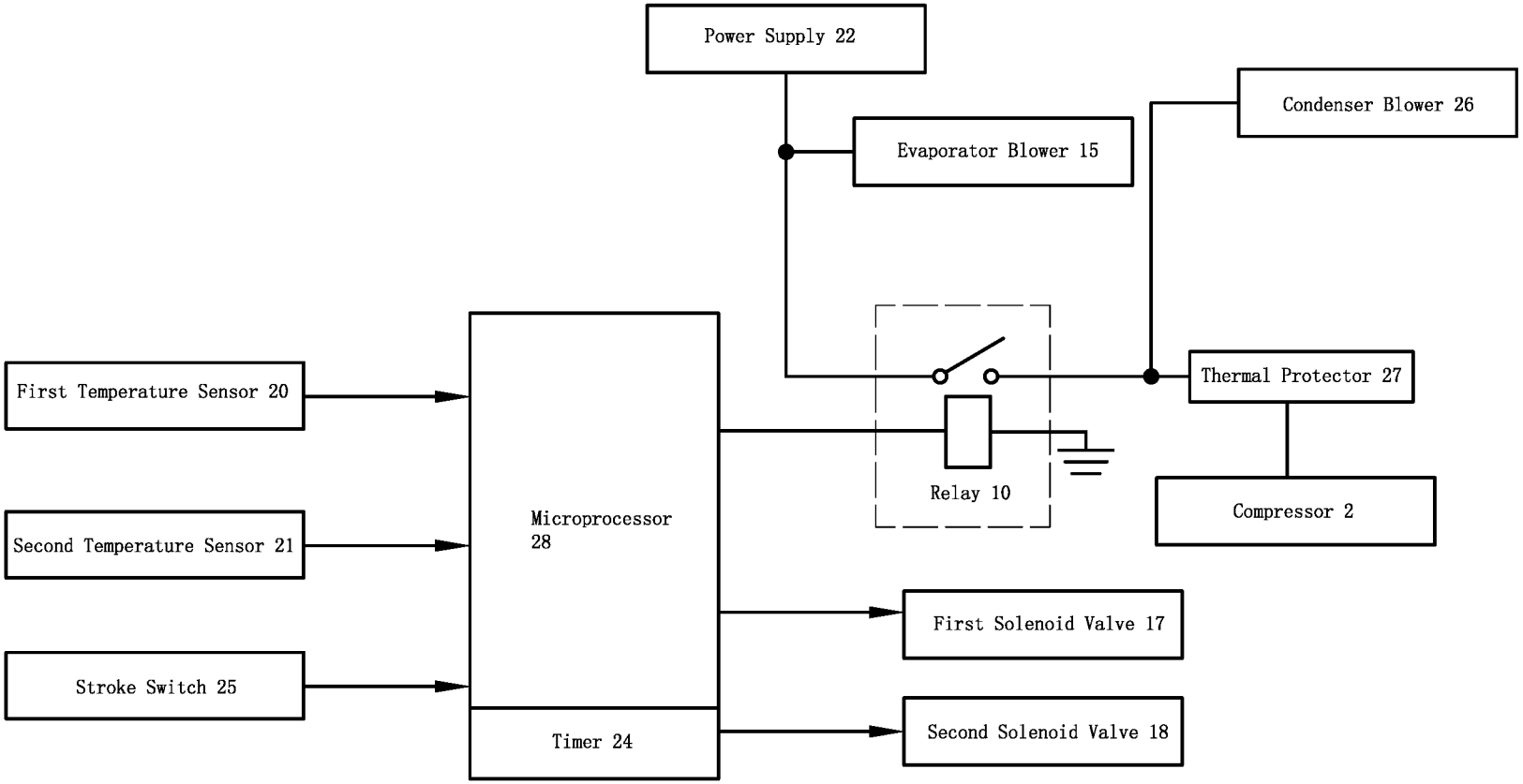
FIG. 19 is a second electric circuit connection diagram of a fourth embodiment of the present invention.

As shown in FIG. 1 through FIG. 7, as well as in FIG. 17 through FIG. 19, the structure and the working process of the fourth embodiment are basically the same as those in the first embodiment. The differences in the structure are:

The present double cooled draft beer machine also comprises a microprocessor (28) used to control the action of the solenoid valve and the first temperature sensor (20) used to detect the temperature. The detection point (29) of the first temperature sensor (20) is located between the refrigeration tube (8) and the beer pipe (7). A stroke switch (25), which will be switched on when beer is discharged from the beer tap (9), is arranged on the beer tap (9), and the stroke switch (25) is connected to the input end of the microprocessor (28). There is a timer (24) inside the microprocessor (28). The stroke switch (25) and the first temperature sensor (20) are connected to the input end of the microprocessor (28) respectively, the solenoid valve is connected to the output end of the microprocessor (28), and a relay (10) used to control the on-off operation of the compressor (2) is also connected to the output end of the microprocessor (28). The electromagnetic coil of the relay (10) is connected to the output end of the microprocessor (28), and the normally open contact of the relay (10) is connected to between the compressor (2) and the power supply (22) of the compressor (2). The first lower limit temperature threshold is set inside the microprocessor (28). When the stroke switch (25) switches on the timer (24) to start timing, and the recorded time is longer than the timing interval set by the microprocessor (28), the microprocessor (28) controls the solenoid valve to act and switches on the compressor (2) to allow the refrigerant to stop flowing toward the evaporator (4), instead, to flow toward the refrigeration tube (8) only. When the temperature detected by the first temperature sensor (20) is equal to or lower than the first lower limit temperature threshold, the microprocessor (28) controls the solenoid valve to act to allow the refrigerant in the refrigeration circuit to stop flowing toward the refrigeration tube (8).

The second temperature sensor (21) which can detect the inner temperature of the cold storage chamber (6) is arranged inside the cold storage chamber (6). The second temperature sensor (21) is connected to the input end of the microprocessor (28). The second lower limit temperature threshold is set inside the microprocessor (28). When the temperature detected by the first temperature sensor (20) is equal to or lower than the first lower limit temperature threshold, the microprocessor (19) controls the solenoid valve to act and switches on the compressor (2) to allow the refrigerant to flow toward the evaporator (4). When the temperature of inflowing beer of the beer pipe (7) is equal to or lower than the first lower limit temperature threshold, and the inner temperature of the cold storage chamber (6) is equal to or lower than the second lower limit temperature threshold, the microprocessor (28) controls the relay (10) to switch off the compressor (2) and make it stop working. The first temperature sensor (20) is arranged on the quick cooler (13) and the detection point (29) of the first temperature sensor (20) is close to the outlet end of the beer pipe (7).

The following is the working process of this embodiment:

The present double cooled draft beer machine comprises a refrigeration circuit including the compressor (2), the condenser (3) and the evaporator (4), and the refrigeration tube (8) is connected to the refrigeration circuit and in parallel with the evaporator (4). This affords two refrigeration modes, firstly, the evaporator (4) can refrigerate the casks (5) in the cold storage chamber (6), and secondly, the refrigeration tube (8) can refrigerate the beer pipe (7). After the present double cooled draft beer machine is powered on, it always refrigerates the refrigeration tube (8) first, so as to ensure beer can always flow out at a relatively low temperature. The first lower limit temperature threshold and the second lower limit temperature threshold of the beer pipe (7), and the timing threshold are set in the microprocessor (28). The range of the first lower limit temperature threshold is 0 to 6 degrees Celsius, and preferably, the first lower limit temperature threshold is 1 degrees Celsius. The range of the second lower limit temperature threshold is 0 to 6 degrees Celsius, and preferably, the second lower limit temperature threshold is 1 degree Celsius. The timing threshold is 5 to 100 seconds and preferably, the timing threshold is 30 seconds. The temperature detected by the first temperature sensor (20) may be the temperature of the beer pipe (7) or the temperature of the refrigeration tube (8). When a temperature conductive medium, such as the temperature conductive mud, is arranged between the refrigeration tube (8) and the beer pipe (7), the temperature detected by the first temperature sensor (20) may also be the temperature of the temperature conductive mud.

When the beer tap (9) opens, the stroke switch (25) is on and sends electronic signals to the microprocessor (28). The microprocessor (28) starts timing with the timer (24). When the recorded time is longer than 30 seconds, it is indicated that much beer is discharged from the beer tap (9). This would take away the cooling capacity in the refrigeration tube (8), makes the temperature of the refrigeration tube (8) increase quickly, and at the meanwhile, the temperature of the beer pipe (7) also increases. At this point, the microprocessor (28) sends electronic signals to the relay (10), and the normally open contact of the relay (10) is closed to close the circuit between the compressor (2) and the power supply (22). Meanwhile, the microprocessor (28) sends electronic signals to the 3-way solenoid valve (16), the 3-way solenoid valve (16) is powered on and acts, connecting the inlet to the outlet which is connected to the refrigeration tube (8), and the compressor (2) is also powered on. At this point, the flowing direction of the refrigerant is switched so that the refrigerant in the refrigeration circuit stops flowing toward the evaporator (4), instead, flows toward the refrigeration tube (8) only. When the refrigerant flows toward the refrigeration tube (8), the temperature of the refrigeration tube (8) decreases, the beer pipe (7) is hence refrigerated, and the temperature of the inflowing beer decreases. When the temperature detected by the first temperature sensor (20) is equal to or lower than 1 degree Celsius, the microprocessor (28) controls the 3-way solenoid valve (16) to power off, and its inlet is connected to the outlet which is connected to the evaporator (4).

The second temperature sensor (21) detects the temperature of the cold storage chamber (6). Only after the refrigeration to the refrigeration tube (8) is fulfilled, the cold storage chamber (6) will be refrigerated. When the beer tap opens and the opening time exceeds 30 seconds, even if the microprocessor (28) is controlling the refrigerant in the refrigeration circuit to flow toward the evaporator (4), the refrigerant will be switched to flowing toward the refrigeration tube (8) to first fulfill the refrigeration to the beer pipe (7), so as to ensure that beer can always flow out at a relatively low temperature. When the refrigeration condition under which the refrigerant flows toward the refrigeration tube (8) is not met, and the temperature inside the cold storage chamber (6) is lower than or equal to 1 degrees Celsius, the microprocessor (28) controls the relay (10) to be powered off, and the compressor (2) is disconnected from the power supply (22) and stops working. When the compressor (2) is working, the condenser blower (26) is also powered on, and it dissipates the heat of the condenser (3). The refrigeration condition under which the refrigerant flows toward the refrigeration tube (8) is that the beer tap (9) opens and the opening time exceeds 30 seconds.

The analysis of the beer discharging time of the beer tap (9) always takes precedence in the present double cooled draft beer machine, no matter when the refrigerant is flowing toward the evaporator (4), or when the compressor (2) is powered off.

As an alternative, as shown in FIG. 7 and FIG. 19, there are two solenoid valves: the first solenoid valve (17) and the second solenoid valve (18). The microprocessor (28) controls the on-off operation of the first solenoid valve (17) and the second solenoid valve (18) respectively. When the first solenoid valve (17) is switched on, the second solenoid valve (18) is switched off. Other contents are the same as the contents in the description above where the 3-way solenoid valve (16) is adopted.

The description of the preferred embodiments thereof serves only as an illustration of the spirit of the invention. It will be understood by those skilled in the art that various changes or supplements in form and details may be made therein without departing from the spirit and scope of the invention as defined by the appended claims.

Although the terms of Cabinet (1), Compressor (2), Condenser (3), Evaporator (4), Cask (5), Cold Storage Chamber (6), Beer Pipe (7), Refrigeration Tube (8), Beer Tap (9), Relay (10), The First Thermostat (11), The Second Thermostat (12), Quick Cooler (13), Mounting Cover (14), Evaporator Blower (15), 3-way Solenoid Valve (16), The First solenoid Valve (17), The Second Solenoid Valve (18), Control Chip (19), The First Temperature Sensor (20), The Second Temperature Sensor (21), Power Supply (22), Flow Sensor (23), Timer (24), Stroke Switch (25), Condenser Blower (26), Thermal Protector (27), Microprocessor (28), Detection Point (29), etc. are often used herein, it does not exclude the possibility to use any other terms. Using such terms is only to describe or explain the nature of the present invention more conveniently. Any additional restrictions are contrary to the spirit of the present invention.

LIST OF REFERENCE NUMERALS

1 Cabinet
2 Compressor
3 Condenser
4 Evaporator
5 Cask
6 Cold Storage Chamber
7 Beer Pipe
8 Refrigeration Tube
9 Beer Tap
10 Relay
11 First Thermostat
12 Second Thermostat
13 Quick Cooler
14 Mounting Cover
15 Evaporator Blower
16 3-Way Solenoid Valve
17 First Solenoid Valve
18 Second Solenoid Valve
19 Control Chip
20 First Temperature Sensor
21 Second Temperature Sensor
22 Power Supply
23 Flow Sensor
24 Timer
25 Stroke Switch
26 Condenser Blower
27 Thermal Protector
28 Microprocessor
29 Detection Point

What is claimed is:

1. A double cooled draft beer machine, comprising:

a cabinet (1);

a refrigeration circuit inside the cabinet (1), the refrigeration circuit including a compressor (2), a condenser (3), and an evaporator (4);

a cold storage chamber (6) inside the cabinet (1), the cold storage chamber (6) used to hold a cask (5), and the evaporator (4) is capable of refrigerating the cold storage chamber (6);

a beer pipe (7) and a refrigeration tube (8) capable of refrigerating the beer pipe (7) are arranged inside the cabinet (1);

a beer tap (9) fixed to an outside of the cabinet (1);

an outer end of the beer pipe (7) connected to the beer tap (9);

an inner end of the beer pipe (7) connected to the cask (5);

at least one solenoid valve, including a first solenoid valve, is set up in the refrigeration circuit, the first solenoid valve used to open or close the refrigeration circuit for refrigerant to flow toward the refrigeration tube (8) or the evaporator (4);

a control chip (19) used to control an action of the first solenoid valve;

a first temperature sensor (20) used to detect temperature; and a detection point (29) of the first temperature sensor (20), the detection point (29) located between the refrigeration tube (8) and the beer pipe (7);

wherein the refrigeration tube (8) is connected to the refrigeration circuit and is in parallel with the evaporator (4);

wherein the first temperature sensor (20) is connected to an input end of the control chip (19), the first solenoid valve is connected to an output end of the control chip (19), and a relay (10) used to control the on-off operation of the compressor (2) is also connected to the output end of the control chip (19);

wherein an electromagnetic coil of the relay (10) is connected to and controlled by the output end of the control chip (19), and a normally open contact of the relay (10) is connected between the compressor (2) and a power supply (22) of the compressor (2);

wherein a first upper limit temperature threshold and a first lower limit temperature threshold of the beer pipe (7) are set inside the control chip (19);

wherein when the temperature detected by the first temperature sensor (20) is higher than the first upper limit temperature threshold, the control chip (19) controls the first solenoid valve to act and switch on the compressor (2) to allow the refrigerant in the refrigeration circuit to stop flowing toward the evaporator (4), and instead to allow the refrigerant in the refrigeration circuit to flow toward the refrigeration tube (8) only; and wherein when the temperature detected by the first temperature sensor (20) is equal to or lower than the first lower limit temperature threshold, the control chip (19) controls the first solenoid valve to act to allow the refrigerant in the refrigeration circuit to stop flowing toward the refrigeration tube (8).

2. The double cooled draft beer machine as claimed in claim 1, further comprising:

a second temperature sensor (21) inside the cold storage chamber (6), the second temperature sensor (21) capable of detecting an inner temperature of the cold storage chamber (6); and the second temperature sensor (21) connected to a input end of the control chip (19), and a second upper limit temperature threshold and a second lower limit temperature threshold of the cold storage chamber (6) are set inside the control chip (19);

wherein when the temperature detected by the first temperature sensor (20) is equal to or lower than the first lower limit temperature threshold, and an inner temperature of the cold storage chamber (6) is higher than the second upper limit temperature threshold, the control chip (19) controls the first solenoid valve to act and switches on the compressor (2) to allow the refrigerant to flow toward the evaporator (4); and wherein when the temperature detected by the first temperature sensor (20) is equal to or lower than the first lower limit temperature threshold, and the inner temperature of the cold storage chamber (6) is equal to or lower than the second lower limit temperature threshold, the control chip (19) controls the relay (10) to switch off the compressor (2) and causes the compressor (2) to stop working.

3. The double cooled draft beer machine as claimed in claim 2 wherein the refrigeration tube (8) and the beer pipe (7) are helically wound into a round or an elliptic cylindrical shaped quick cooler (13);

wherein the quick cooler (13) comprises at least one mixing layer of a round or an elliptic cylindrical shape, each of the at least one mixing layer is formed by helically winding the refrigeration tube (8) and the beer pipe (7) which are arranged in an abreast manner;

wherein an inflowing direction of the beer pipe (7) is opposite a flowing direction of refrigerant in the refrigeration tube (8); and wherein the first temperature sensor (20) is arranged on the quick cooler (13) and the detection point (29) of the first temperature sensor (20) is close to an outlet end of the beer pipe (7).

4. The double cooled draft beer machine as claimed in claim 3 wherein the first solenoid valve is a 3-way solenoid valve (16); and wherein an inlet of the 3-way solenoid valve (16) is connected to a refrigerant outlet of the condenser (3), a first outlet of the 3-way solenoid valve (16) is connected to the refrigeration tube (8), and a second outlet of the 3-way solenoid valve (16) is connected to the evaporator (4).

* * * * *